US007064738B2

(12) United States Patent
Igarashi

(10) Patent No.: US 7,064,738 B2
(45) Date of Patent: Jun. 20, 2006

(54) LIQUID CRYSTAL DISPLAY DEVICE AND DRIVING METHOD THEREOF

(75) Inventor: Youichi Igarashi, Mobara (JP)

(73) Assignee: Hitachi, Ltd., Tokyo (JP)

( * ) Notice: Subject to any disclaimer, the term of this patent is extended or adjusted under 35 U.S.C. 154(b) by 416 days.

(21) Appl. No.: 10/105,307

(22) Filed: Mar. 26, 2002

(65) Prior Publication Data

US 2002/0140662 A1 Oct. 3, 2002

(30) Foreign Application Priority Data

Mar. 30, 2001 (JP) ..... 2001-098447

(51) Int. Cl.
*G09G 3/36* (2006.01)

(52) U.S. Cl. ..... 345/99; 345/98; 345/204

(58) Field of Classification Search ..... 345/87–104, 345/42, 55, 204, 211; 327/158, 147, 292
See application file for complete search history.

(56) References Cited

U.S. PATENT DOCUMENTS 5,642,069 A * 6/1997 Waite ..... 327/292
5,682,112 A * 10/1997 Fukushima ..... 327/147
5,969,558 A * 10/1999 Abe ..... 327/292
5,986,641 A * 11/1999 Shimamoto ..... 345/593
6,414,528 B1 * 7/2002 Usui ..... 327/158

* cited by examiner

*Primary Examiner*—Lun-Yi Lao
(74) *Attorney, Agent, or Firm*—Antonelli, Terry, Stout and Kraus, LLP.

(57) ABSTRACT

On an interface of a liquid crystal display device, which converts the number of pixels of image signals inputted from an external signal source, such as a host computer, into image signals having a smaller number of pixels and fetches the image signs into drain drivers at double edges of a clock signal of low frequency, a clock surveillance unit is mounted, which includes a clock synthesizer and a clock comparator circuit, and which detects the presence or the absence of an irregularity in the timing of a pixel clock signal inputted from the external signal source and outputs a determination of the normal/irregular status of the pixel clock signal. When it is determined that the pixel clock signal is irregular, the supply of image data to the drain drivers from a parallel-serial converter is stopped, so that the generation of an irregularity in the display produced by the liquid crystal display device can be obviated.

11 Claims, 19 Drawing Sheets

LIQUID CRYSTAL DISPLAY DEVICE AND DRIVING METHOD THEREOF

BACKGROUND OF THE INVENTION

The present invention relates to a liquid crystal display device; and, more particularly, the invention relates to a liquid crystal display device in which there is no disturbance in the display caused by an abnormality of the timing of pixel clock signals for generating image data supplied to a driving circuit for driving the liquid crystal, and to a driving method therefore.

In an active matrix type liquid crystal display device, which includes active elements, such as thin film transistors (TFT), for respective pixels, and in which switching driving of these active elements is carried out, liquid crystal driving voltages (gray scale voltages) are applied to pixel electrodes through the active elements; and, hence, there is no cross talk between respective pixels, which makes it possible to generate a multi-gray-scale display without using a particular driving method for preventing cross talk, which typically occurs in a simple matrix type liquid crystal display device.

FIG. 12 is a block diagram showing one example of an active matrix type liquid crystal display device, while FIG. 13 and FIG. 14 are waveform timing diagrams which respectively show lateral-direction timing, that is, horizontal-direction timing, and longitudinal-direction timing, that is, vertical-direction timing, with respect to the display control system shown in FIG. 12.

The liquid crystal display device is provided with an interface circuit board on which an interface circuit is mounted, which interface circuit applies pixel data, pixel clock signals and various types of driving voltages to a liquid crystal display panel TFT-LCD upon receiving control signals, including image data and pixel clock signals (the pixel clock signals being referred to as a pixel clock or simply a clock hereinafter) that are supplied from an external signal source, such as a host computer or the like, and other clock signals for synchronization.

The interface circuit includes a display control device and a power source circuit, and it has a data bus which transfers a first pixel, a data bus which transfers a second pixel, a signal line for outputting clocks D1, D2 for fetching pixel data into drain drivers, a signal line for outputting a frame starting direction signal for driving gate drivers and a signal line for outputting gate clocks (clocks G) to the liquid crystal display panel TFT-LCD. Further, the power source circuit is constituted of a positive voltage generation circuit, a negative voltage generation circuit, a multiplexer which synthesizes a positive voltage and a negative voltage, a counter electrode voltage generation circuit and a gate voltage generation circuit.

The number of display pixels of the liquid crystal display panel TFT-LCD which constitutes the liquid crystal display device is 1024 in the lateral direction×768 in the longitudinal direction. The interface circuit board, which receives display data and various types of control signals from the host computer, transfers the data and the signals for a two pixel unit to the liquid crystal display panel. That is, the interface circuit board synthesizes respective data of red (R), green (G), blue (B) as a set and transfers the data and the symbols for two pixels in every unit time to the liquid crystal display panel TFT-LCD through a data line, which is indicated by a bold arrow in the drawing.

With respect to the clock which becomes a reference with respect to the unit time, one half of the frequency for one pixel is transmitted from the host computer (also referred to as an external signal source hereinafter) to the drain drivers of the liquid crystal display panel TFT-LCD through clock lines indicated by narrow arrows in the drawing. As a specific example, the frequency of the clock becomes 32.5 MHz, which is one half of 65 MHz.

To explain the constitution of the liquid crystal display panel TFT-LCD, assuming a display screen as the reference, the drain drivers (TFT drivers) are arranged in the lateral direction and these drain drivers are connected to drain lines of thin film transistors TFT so as to supply voltages for driving the liquid crystal to the thin film transistors TFT. Further, the gate drivers are connected to gate lines so as to supply voltages to gates of the thin film transistors TFT for a fixed time (1 horizontal operation time, display time for 1 line).

The display control device is constituted of a semiconductor integrated circuit (LSI), which is also referred to as a TCON, and receives the image data and control signals from the host computer and outputs the data and signals for two pixels to the drain drivers and the gate drivers based on these data and signals. Here, the data line for one pixel transmits data of 18 bits (6 bits for each of R, G, B). Accordingly, by adopting a 2-pixel data outputting technique, the total data line transmits data of 36 bits.

The reason why the number of pixel data transferred from the host computer to the display control device of the liquid crystal display device and the number of pixel data transferred from the display control device to the drain drivers of the liquid crystal display panel are respectively two pixels is as follows. That is, when 65 MHz, which is the reference clock for 1 pixel, is adopted, there arises a problem in that the data cannot be transferred between these devices and between the device and drain drivers. Accordingly, a two pixel transfer technique is adopted.

As shown in FIG. 13 and FIG. 14, pulses of one horizontal time period are supplied to the gate drivers based on the horizontal synchronizing signal and the display timing signal, such that the voltage is supplied to the gate lines of the thin film transistors TFT for every one horizontal time. In every frame period, a frame starting direction signal is also generated, based on the vertical synchronizing signal, such that the display is generated from the first line.

The positive voltage generation circuit, the negative voltage generation circuit and the multiplexer of the power source circuit alternate the voltage applied to the liquid crystal every fixed time, such that the same voltage is not applied to the same liquid crystal for a long time. Here, "to alternate" means to change the voltage given to the drain drivers to the positive voltage side and the negative voltage side every fixed time using a counter electrode voltage as a reference. Here, the period of alternation is performed in accordance with every frame period.

SUMMARY OF THE INVENTION

With respect to the above-mentioned thin film transistor type liquid crystal display device, which operates in accordance with the conventional technique, since plural image data are transferred to the liquid crystal display panel (for 2 pixels), the size of the printed circuit board, which constitutes a wiring path, becomes large, and this constitutes one of the factors which increases the manufacturing cost.

To cope with such a problem, a so-called LVDS (Low Voltage Differential Signaling) data transferring method is adopted for transferring the image data from the host computer to the liquid crystal display device. The LVDS transferring method is a method in which data is transferred data at high speed by making use of differential signals of + (plus) and − (minus) polarities with a small amplitude.

FIGS. 15(*a*), 15(*b*), 16(*a*), and 16(*b*) are explanatory views of the LVDS transferring method. FIGS. 15(*a*) and 15(*b*) are diagrams which illustrate the LVDS transferring method, wherein FIG. 15(*a*) is a conceptual diagram of the LVDS transfer method and FIG. 15(*b*) is a diagram showing alternating data signals. FIGS. 16(*a*) and 16(*b*) are diagrams which illustrate the LVDS transferring method, wherein FIG. 16(*a*) is a constitutional diagram of transferring lines of the LVDS, and FIG. 16(*b*) is a diagram showing display data and clocks which are transferred through the transferring lines of the LVDS.

To reduce the number of transfer lines at the host computer, which constitute the transmitting side, parallel data of 7 bits, for example, is converted into serial data, and this data is transferred with one pair of data per one clock (here, at 65 MHz). The transferred data is restored to parallel data of 7 bits at the liquid crystal display side. This data is inputted to the display control device.

The transfer of data from the display control device to the drain drivers of the liquid crystal display panel is configured such that the data can be transferred with a data width for 1 pixel by setting the clock D2 to a half cycle and using drain drivers having a double-edged specification.

FIG. 17 is a block diagram showing an example of a liquid crystal display device which adopts an LVDS transferring method. Further, FIG. 18 is a timing chart of input and output signals of the display control device, which employs a double-edged image data fetching method.

In FIG. 17, symbols and descriptive legends identical with those shown in FIG. 12 indicate parts having the same functions. A graphic controller and an LVDS transmitting circuit are arranged at a host computer side, and an LVDS receiving circuit is arranged at a liquid crystal display device side. Display data and control signals outputted from the host computer side are converted into the above-mentioned differential signals by the LVDS transmitting circuit, and then they are inputted to the LVDS receiving circuit mounted on an interface substrate of a liquid crystal display device.

The display data and the control signals which are restored by the LVDS receiving circuit are supplied to a liquid crystal display panel TFT-LCD through a display control device. The display data is transferred by a data bus for 1 pixel and, as shown in FIG. 18, is fetched to the drain drivers at double edges (rising edge, falling edge) of a clock D2 of 32.5 MHz. The maximum frequency of the reference clock (clock D2) supplied to the drain drivers of the liquid crystal display device TFT-LCD and the display data becomes 32.5 MHz.

In this manner, using drain drivers which employ the LVDS method and the double-edged specification, it is possible to realize a thin film transistor type liquid crystal display device that has a low manufacturing cost, without increasing the size of the printed circuit board on which the interface circuit thereof is mounted.

However, the above-mentioned constitution of the conventional liquid crystal display device has a problem in that it is also necessary to change the host computer side constitution in accordance with the LVDS specification.

To cope with such a problem, the applicant of the present application proposed a liquid crystal display device which makes it possible to fetch data to the drain drivers at a low clock frequency using an interface which does not change the host computer side constitution, that is, with an interface which does not adopt the above-mentioned LVDS method (Japanese laid-open patent publication 338938/2000).

The above-mentioned proposal is configured so as to be capable of converting the number of pixels from the host computer to a smaller number of pixels and also of using drain drivers of a double-edged specification, which enables the fetching of the number of pixels into the drain drivers using clock signals of low frequency.

To be more specific, to fetch the display data into the drain drivers at both (double edges) rising and falling edges of the clock signal, the device is equipped with a clock multiplying circuit for multiplying the frequency of the clock signal inputted from the host computer, and the image data inputted from the host computer is converted into a smaller number of display data using the multiplied clock signal.

FIG. 19 is a block diagram illustrating the basic feature of a double-edged image data fetching method, and FIG. 20 is a waveform diagram illustrating the operation thereof. In FIG. 19, a display control device mounted on an interface circuit board of a liquid crystal display device receives clock signals (DCLK) inputted from a host computer, n pieces of image data (Data) and other control signals (H-Sync: horizontal synchronizing signals, V-Sync: vertical synchronizing signals and the like).

The clock signal (DCLK) which constitutes a basic clock, is inputted to a parallel-serial converter P/S and, at the same time, is supplied to a clock signal synthesizer CLS. The clock signal synthesizer CLS multiplies the inputted clock signal DCLK "a" times (here, a=2) to form a clock signal 2DCLK, and this clock signal is supplied to the parallel-serial converter circuit P/S.

The display control device converts n pieces of image data into m pieces of image data ($m \leqq n$) in the parallel-serial converter P/S, and the image data is fetched at double edges, consisting of a rising edge and a falling edge, of the basic clock DCLK by the drain drivers of the doubled-edged specification, whereby the image data is displayed on the liquid crystal panel.

FIG. 21 is a block diagram showing an example of a liquid crystal display device which employs the above-mentioned double-edged fetching method. A liquid crystal display panel TFT-LCD is a high definition panel having 1024×3×768 pixels similar to the panel explained in conjunction with FIG. 17. A plurality of drain drivers having the double-edged specification are arranged corresponding to the rows of pixels in the lateral direction, and a plurality of gate drivers are arranged corresponding to the columns of pixels in the longitudinal direction.

A display control device and a power source circuit are mounted on an interface circuit board. Further, a PLL, which multiplies a clock DCLK (reference clock) of 32.5 MHz, which constitutes a pixel clock inputted from a host computer, twice, is mounted on the interface circuit board. That is, the reference clock of 32.5 MHz inputted from the host computer is supplied to a 1 pixel data converting circuit of the display control device after the frequency is multiplied to obtain 65 MHz by a clock synthesizer (constituted of the PLL).

Two pixels inputted from the host computer, that is, pixel data of red (R), green (G), blue (B) for the first pixel and pixel data of red (R), green (G), blue (B) for the second pixel are converted into serial data of one pixel by the one pixel data converting circuit, which constitutes a parallel-serial converter, and then they are outputted to the drain drivers. Further, the display control device outputs a clock D at a frequency equal to that of the reference clock inputted from the host computer to the drain drivers and also outputs a frame starting direction signal and a gate clock (clock G) to the gate drivers.

The power source circuit includes a positive voltage generation circuit, a negative voltage generation circuit, an analogue multiplexer, a counter electrode generation circuit and a gate voltage generation circuit. The power source circuit is configured to effect alternate driving of the drain drivers, as explained above in connection with the related art, using the positive voltage generation circuit, the negative voltage generation circuit and the analogue multiplexer.

The drain drivers fetch and latch the pixel data inputted from the display control device through a data bus at both (double edges) the rising edge and the falling edge of the clock D and output the pixel data to lines to be selected by the gate drivers so as to display the pixels.

Due to such a constitution, even when the data constitution of the drain drivers is for one pixel, the device can cope with the inputting of display data for two pixels so that a liquid crystal display device of high definition can be obtained by using an interface circuit having the conventional constitution, without requiring a high-speed transfer of display data from the host computer.

Due to such a constitution, the pixel data from the host computer is converted into pixel data with a smaller number of pixels, and the pixel data can be fetched by drain drivers with a clock of low frequency, so that the high-speed transfer of image data can be realized without adopting the LVDS method.

The host computer, at the time of starting thereof, transmits the image data from a graphic controller to the liquid crystal display device side by sequentially converting the resolution of the image data (for example, 640 (720)×350→640×480→640×350→1024×768).

An image signal ineffective signal is transmitted in conformity with the converting timing of the resolution so as to suppress the influence of the conversion of the resolution on the image display. However, in this transitional transmission time, there may be a case that the disturbance is generated with respect to waveforms of the clock, the horizontal synchronizing signal H-Sync, the vertical synchronizing signal V-Sync and image data signals. That is, as indicated with an arrow A in FIG. 20 in an enlarged form, a signal level which is to be recognized as a low level (Low) has a fluctuation in waveform, and, hence, the signal level is erroneously recognized as being high level (High).

Conventionally, assuming that no irregularities with respect to the clock inputted from the outside (also referred to as an external clock), such irregularities of the clock have not been taken into consideration. However, in actual operation, there may be a case in which the above-mentioned fluctuation is generated, and this induces a miscounting of the clock, whereby the transmission of the image signal ineffective signal is disturbed.

Accordingly, it is an object of the present invention to provide a liquid crystal display device and a driving method thereof which can obviate the generation of display irregularities by recognizing the normal/irregular state of the above-mentioned external clock and stopping the supply of image signals to drivers of a liquid crystal display device or performing data display by replacing the external clock with a pseudo clock from a pseudo clock generation circuit, which is separately provided, when the external clock is in error.

To achieve the above-mentioned object, the present invention is directed to a liquid crystal display device, which converts the number of pixels from a host computer into a smaller number of pixels, and has drain drivers of a double-edged specification in which these pixels are fetched with a clock signal of low frequency, wherein the display control device is further provided with clock surveillance means which detects the presence or the absence of an irregularity in the timing of a pixel clock signal inputted from the host computer which constitutes an external signal source. A typical constitution of the present invention is as follows.

First of all, as a method of driving a liquid crystal display device according to the present invention, the following constitutions can be considered.

(1) In a liquid crystal display device comprising a liquid crystal display panel, which has a plurality of pixels constituted of active elements and formed in a matrix array, a plurality of drain driven which apply display signals based on control signals, including image data and pixel clock signals, inputted from an external signal source to a plurality of pixels in the lateral direction of the matrix, a plurality of gate drivers which apply scanning signals to a plurality of pixels in the longitudinal direction of the matrix and a display control device which has parallel-serial conversion means which performs parallel-serial conversion of the image data based on the pixel clock signals and supplies the image data to the drain drivers as display signals, the display control device includes clock surveillance means for detecting the presence or the absence of an irregularity in the timing of the pixel clock signals inputted from the external signal source, so that when the clock surveillance means detects the presence of an irregularity in timing, the supply of the image data from the display control device to the drain drivers is stops.

Due to such a constitution, when the clock surveillance means detects the irregularity of timing of the clock, the clock surveillance means determines that the clock is not normal. That is, it is determined that this state is a state in which the host computer side has not been completely started or the state represents a transitional period which follows the change of an operation mode; and, hence, it is possible to take protective processing prevent the generation of the irregularity of display by bringing an inner power source into an inoperable state at the liquid crystal display device side.

(2) In a liquid crystal display device comprising a liquid crystal display panel which has a plurality of pixels constituted of active elements and formed in a matrix array, a plurality of drain drivers which apply driving voltages based on control signals, including image data and pixel clock signals, inputted from an external signal source to a plurality of pixels in the lateral direction of the matrix, a plurality of gate drivers which apply scanning voltages to a plurality of pixels in the longitudinal direction of the matrix, and a display control device which has parallel-serial conversion means which performs parallel-serial conversion of the image data based on the pixel clock signals and supplies the image data to the drain drivers, the display control device includes clock surveillance means for detecting the presence or the absence of an irregularity in the timing of the pixel clock signals inputted from the external signal source, and inner pixel clock signal generating means for generating pseudo clock signals equivalent to the pixel clock signals, so that when the clock surveillance means detects the presence of an irregularity in timing, the pseudo clock signals generated by the inner pixel clock signal generating means are supplied to the display control device.

Due to such a constitution, when the clock surveillance means detects an irregularity in the timing of the clock, an irregular display is obviated by performing a pseudo image display, so that a normal image display can be performed at a point of time at which the above-mentioned timing is restored.

The following devices are examples of liquid crystal display devices of the present invention, which are driven by the above-mentioned driving method.

(3) In a liquid crystal display device comprising a liquid crystal display panel which has a plurality of pixels being constituted of active elements and formed in a matrix array, a plurality of drain drivers which apply driving voltages based on control signals, including image data and pixel clock signals, inputted from an external signal source to a plurality of pixels in the lateral direction of the matrix, a plurality of gate drivers which apply scanning voltages to a plurality of pixels in the longitudinal direction of the matrix, and a display control device which has parallel-serial conversion means which performs parallel-serial conversion of image data based on the pixel clock signals and supplies the image data to the drain drivers, the display control device includes a clock signal synthesizer which generates reference clock signals which are formed by multiplying the frequency of the pixel clock signals inputted from the external signal source by "a" times, and a clock signal comparator circuit which compares the inputted pixel clock signals and an output of the reference clock signals of the clock signal synthesizer, determines whether it is effective or ineffective based on the presence or the absence of an irregularity in the timing of the pixel clock signals, and outputs a clock ineffective signal which stops the supply of the pixel clock signals to the parallel-serial converting means when the result of the determination is that the external clock is ineffective.

Due to such a constitution, it is possible to obtain a liquid crystal display device which, when the clock surveillance means detects irregularities in the timing of the clock, can determine that the clock is not being normally inputted and brings the inner power source into an inoperable state at the liquid crystal display device side so as to prevent the generation of an irregularity in the display.

(4) In a liquid crystal display device comprising a liquid crystal display panel which has a plurality of pixels constituted of active elements and formed in a matrix array, a plurality of drain drivers which apply driving voltages based on control signals, including image data and pixel clock signals, inputted from an external signal source to a plurality of pixels in the lateral direction of the matrix, a plurality of gate drivers which apply scanning voltages to a plurality of pixels in the longitudinal direction of the matrix, and a display control device which has parallel-serial conversion means which performs parallel-serial conversion of the image data based on the pixel clock signals and supplies the image data to the drain drivers, the display control device includes a clock signal synthesizer which generates reference clock signals which are formed by multiplying the frequency of the pixel clock signals inputted from the external signal source by "a" times, a clock signal comparator circuit which compares the inputted pixel clock signals and an output of the reference clock signals of the clock signal synthesizer and determines whether it is effective or ineffective based on the presence or the absence of the irregularity of timing of the pixel clock signals, an inner clock signal generation circuit which generates pseudo clock signals equivalent to the image clock signals, and a clock signal switching circuit which stops the supply of the pixel clocks to the parallel-serial converting means and also supplies the pseudo clock signals outputted from the inner clock generation circuit to the parallel-serial converter when the result of the determination of the clock signal comparator circuit is that the external clock is ineffective.

Due to such a constitution, it is possible to obtain a liquid crystal display device which generates a pseudo image display when the clock surveillance means detects an irregularity in the timing of the clock so as to prevent the generation of an irregularity in the display.

Further, specific constitutions of the liquid crystal display device of the present invention will be described hereinafter.

(5) In the constitution (3) or (4), the multiplication factor "a" of the clock signal synthesizer is n or 1/n, wherein n is an integer that satisfies $n \geqq 2$.

(6) In any one of the constitutions (3) to (5), provided that the number of image data is set to N pieces, the number of display data inputted to the drain drivers of the liquid crystal display panel is set to M pieces, and N/M is set to satisfy the relationship of 1/a (a: integer), the N pieces of display data is converted into M pieces of display data($M \leqq N$) based on clocks $a \times CL$, which is obtained by multiplying the frequency "a" times using the clock multiplying circuit; and, thereafter, the M pieces of display data are inputted to the drain drivers at double edges, consisting of the rising and falling edges, of the clocks CL (7) In any one of the constitutions (3) to (6), the number N of image data from the external signal source is 2, the number M of image data inputted to the liquid crystal display panel is 1, the clock signal synthesizer is a PLL, and the multiplication factor "a" thereof is 2.

(8) In any one of the constitutions (3) to (7), the frequency of the pixel clock signals inputted from the external signal source is 323 MHz and the drain driver is a drain driver responding to double edges.

The above-mentioned PLL, which generates the clock signal, has a simple constitution, and other circuits which constitute the interface circuit and the drain drivers can be constituted of existing semiconductor circuits so that there is no problem with respect to the reliability of operation.

Here, it is needless to say that the present invention is not limited to the above-mentioned constitutions and various modifications are possible without departing from the technical concept of the present invention.

BRIEF DESCRIPTION OF THE DRAWINGS

FIGS. 11A and 11B are views showing the mounting position of the interface printed circuit board at the liquid crystal display panel, wherein FIG. 11A is a plan view of the liquid crystal display panel PNL having a flexible printed circuit board FPC1 connected thereto, and FIG. 11B is a plan view of the interface printed circuit board PC mounted on a back surface of the flexible printed circuit board FPC1;

DETAILED DESCRIPTION

Various embodiments of the present invention will be explained in detail in conjunction with the accompanying drawings.

Figure 1:
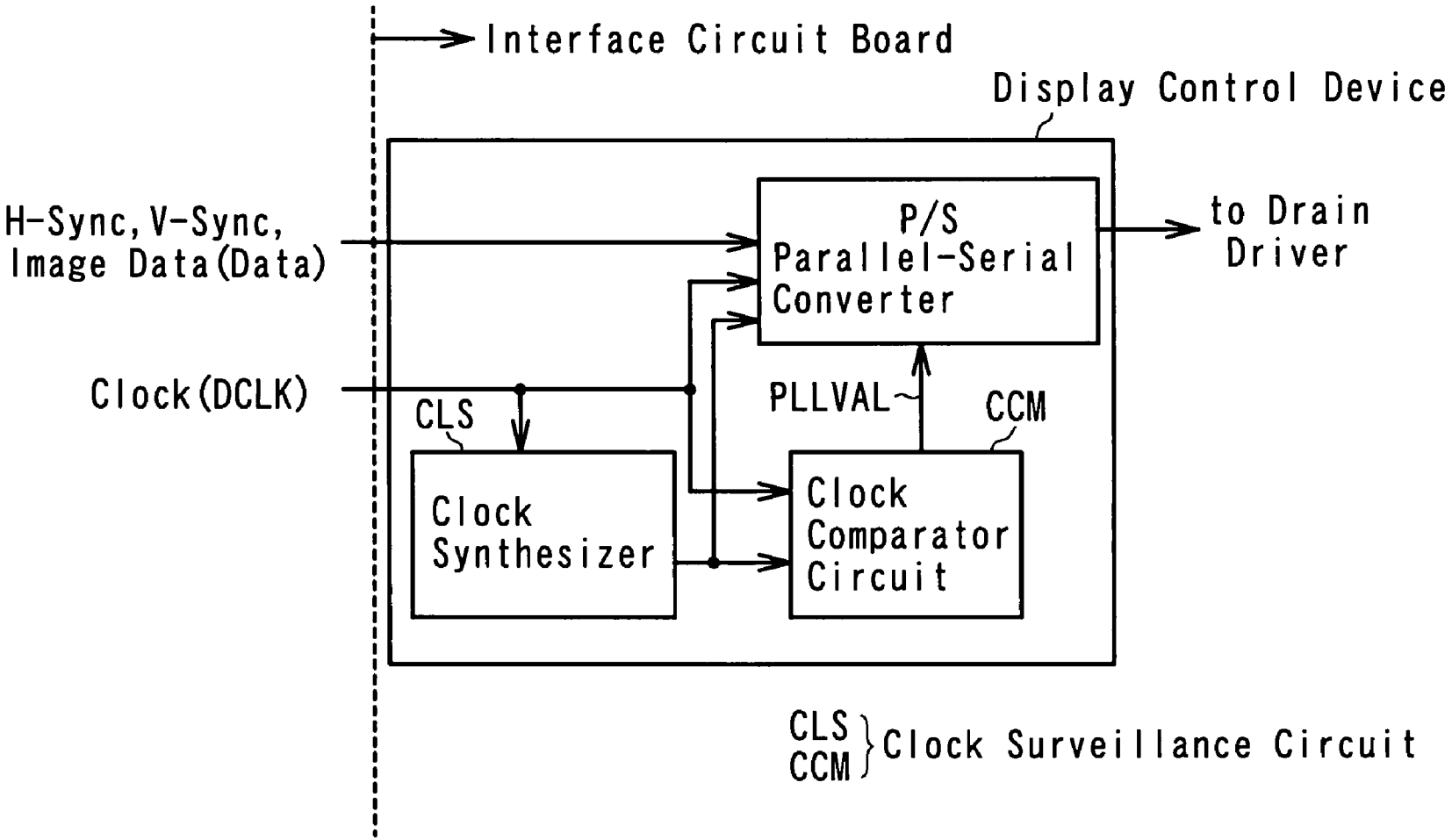
FIG. 1 is a block diagram showing an example of a display control device for a liquid crystal display device according to the present invention.

FIG. 1 is a block diagram showing a display control device for use in a first embodiment of a liquid crystal display device according to the present invention. In FIG. 1, a display control device which is mounted on an interface circuit board includes a parallel-serial converter P/S, a clock synthesizer (PLL) CLS and a clock comparator circuit CCM. The clock synthesizer CLS and the clock comparator circuit CCM constitute a clock surveillance circuit.

The display control device receives a clock DCLK, n pieces of image data (Data) and other control signals (H-Sync: horizontal synchronizing signal, V-Sync: vertical synchronizing signal and the like).

The clock DCLK, which constitutes a basic clock, is inputted to the parallel-serial converter P-S and, at the same time, is supplied to the clock synthesizer CLS. The clock synthesizer CLS multiplies the inputted clock DCLK by "a" times (here, a=2) so as to form the clock 2 DCLK and this clock signal 2 DCLK is supplied to the parallel-serial converter P/S and the clock comparator circuit CCM.

n pieces of image data inputted into the parallel-serial converter are converted into m pieces of image data ($m \leqq n$), and the image data are fetched at double edges consisting of a rising edge and a falling edge of the basic clock DCLK in drain drivers having a double-edged specification and are displayed on a liquid crystal display panel.

The clock comparator circuit CCM compares the reference clock DCLK and the twice-multiplied-clock 2 DCLK so as to determine whether the frequency of the clock DCLK is normal or irregular, and an output of the result of determination (determination output) PLLVAL (normal=high level: High, irregular=low level: Low) is supplied to the parallel-serial converter P/S.

When it is determined that the frequency of the clock DCLK is abnormal, the output PLLVAL becomes low level (Low), and the supply of the image data from the parallel-serial converter P/S to the drain drivers is stopped with the output PLLVAL at the low level.

Figure 2:
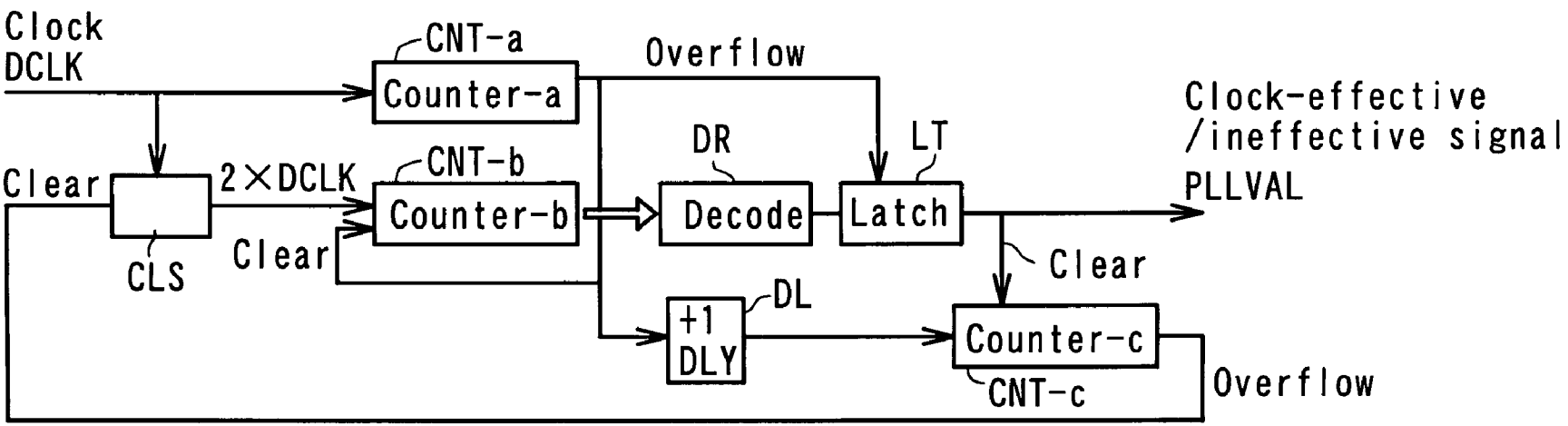
FIG. 2 is a block diagram showing an example of the clock surveillance circuit in FIG. 1.
Figure 3:
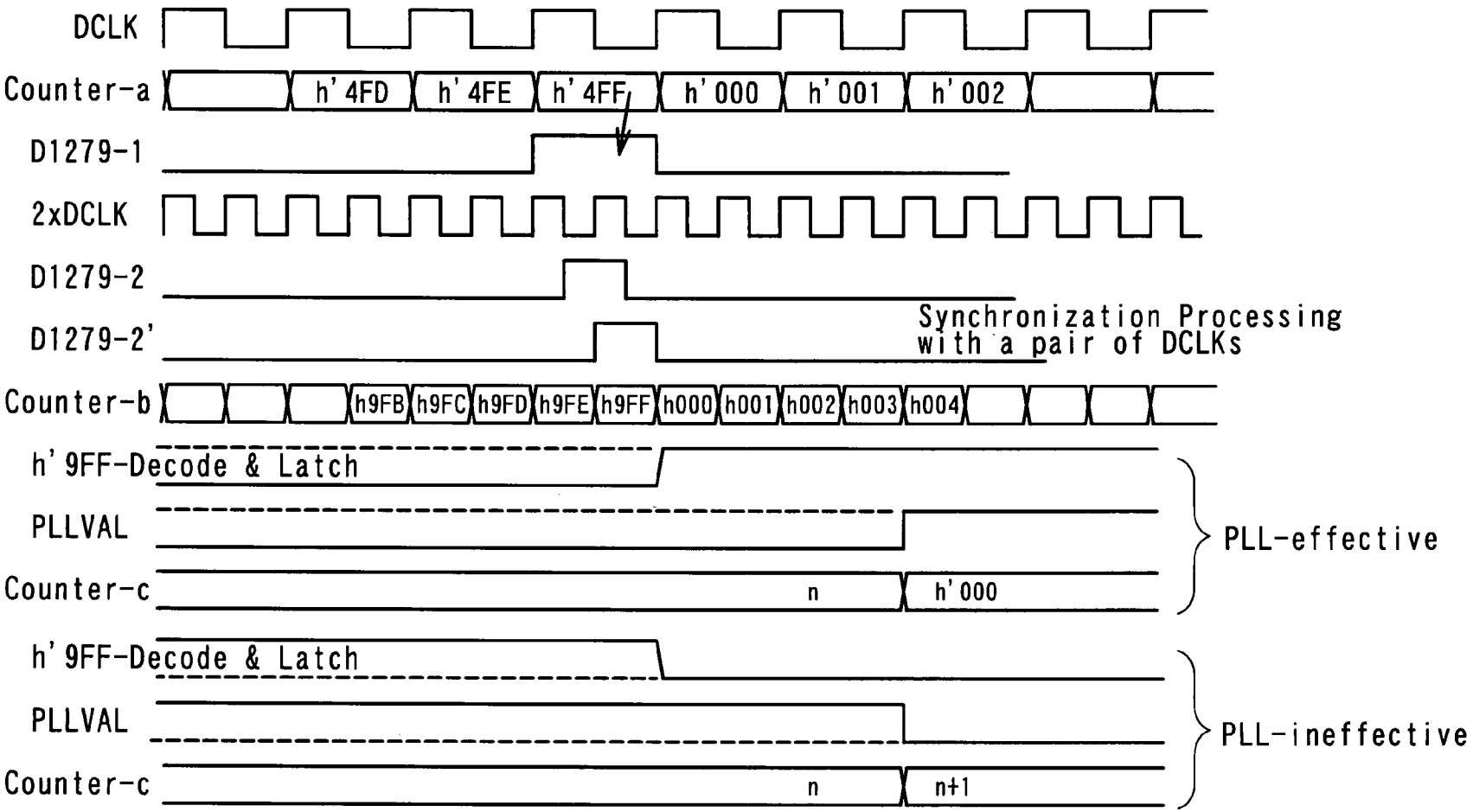
FIG. 3 is a timing chart based on the operation of the clock surveillance circuit shown in FIG. 2.
Figure 4:
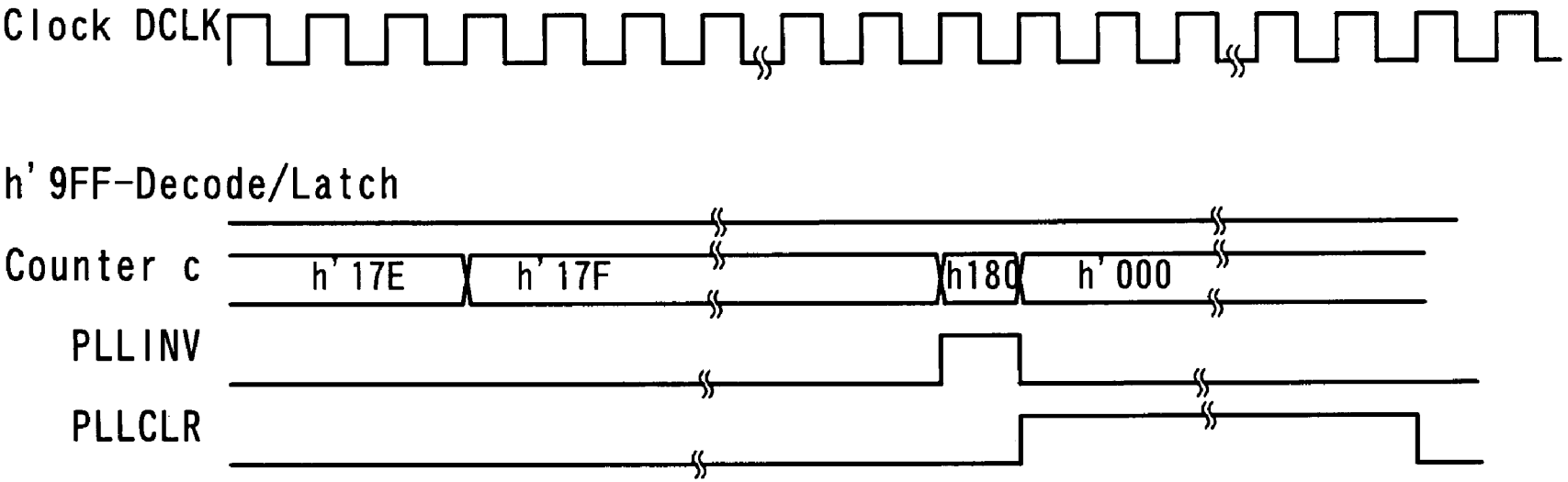
FIG. 4 is a timing chart based on the operation of the clock surveillance circuit shown in FIG. 2.

FIG. 2 is a block diagram showing an example of the clock surveillance circuit shown in FIG. 1. Further, FIG. 3 and FIG. 4 are timing charts based on the operation shown in FIG. 2. In connection with this embodiment, the following explanation is directed to an example in which the multiplication factor is set to "2", and the clock DCLK is set to 1280 pulses, so that the multiplied clock (reference clock) 2×DCLK Is set to 2560 pulses. However, the embodiment is not limited to such an example. The multiplication factor can be n times or 1/n times ($n \geqq 2$, n being an integer). Hereinafter, the operation of the clock surveillance circuit shown in FIG. 2 will be explained in conjunction with FIG. 3 and FIG. 4.

The clock DCLK, which constitutes the reference clock signal inputted from the host computer, is inputted to a count-up clock input of a counter-a CNT-a and a clock synthesizer CLS. A signal 2×DCLK, which constitutes an output of the clock synthesizer CLS, is inputted to a counter-b CNT-b as an count-up clock.

Upon receiving the input of the clock DCLK, the counter-a CNT-a increases its count value by +1. Then, when the count value becomes 1280, the value of the counter-b CNT-b is checked.

When the value of counter-b CNT-b is 2560 (=1280×2), it is determined that the clock synthesizer CSL is operating normally or the inputted clock DCLK is normal. In this circuit, when the clock DCLK is determined to be normal, the output PLLVAL assumes a high level. When the value of counter-b CNT-b is not 2560, it is determined that the operation of the clock synthesizer CLS is irregular, and the output of the PLLVAL assumes the low level. Here, a counter (counter-c CNT-c), which operates to store the number of the occurrences of irregularities, performs a counting-up by +1. When the clock synthesizer CLS restores the normal operation (when the value of counter-b CNT-b becomes 2560), the counter-c CNT-c is cleared.

In a case in which the clock synthesizer CLS is prevented from assuming a normal operation, it is possible that a PLL which constitutes the clock synthesizer CLS is locked, so that a clock of irregular frequency is outputted. Accordingly, the clock synthesizer CLS has to be reset when the value of the counter-c CNT-c becomes 384 (predetermined value).

When the count value of the counter-a CNT-a becomes 1280, the counter-a CNT-a and the counter-b CNT-b are cleared and perform their operations again continuously. Further, the count value 1280, which is a decode value of the above-mentioned counter-a CNT-a, is determined based on the performance of the PLL, which constitutes the clock synthesizer in operation.

The count value 384, which is the predetermined value of the counter-c CNT-c, is determined in accordance with approximately one frame time of a thin film transistor TFT type liquid crystal display device and the value is arbitrarily set. The count value of the counter-b CNT-b depends on the output frequency of the clock synthesizer CLS and is set to 2560 by multiplying the frequency twice in the above-mentioned example. However, the count value becomes 3840 by multiplying the frequency three times, and it becomes 5120 by multiplying the frequency four times.

Figure 5:
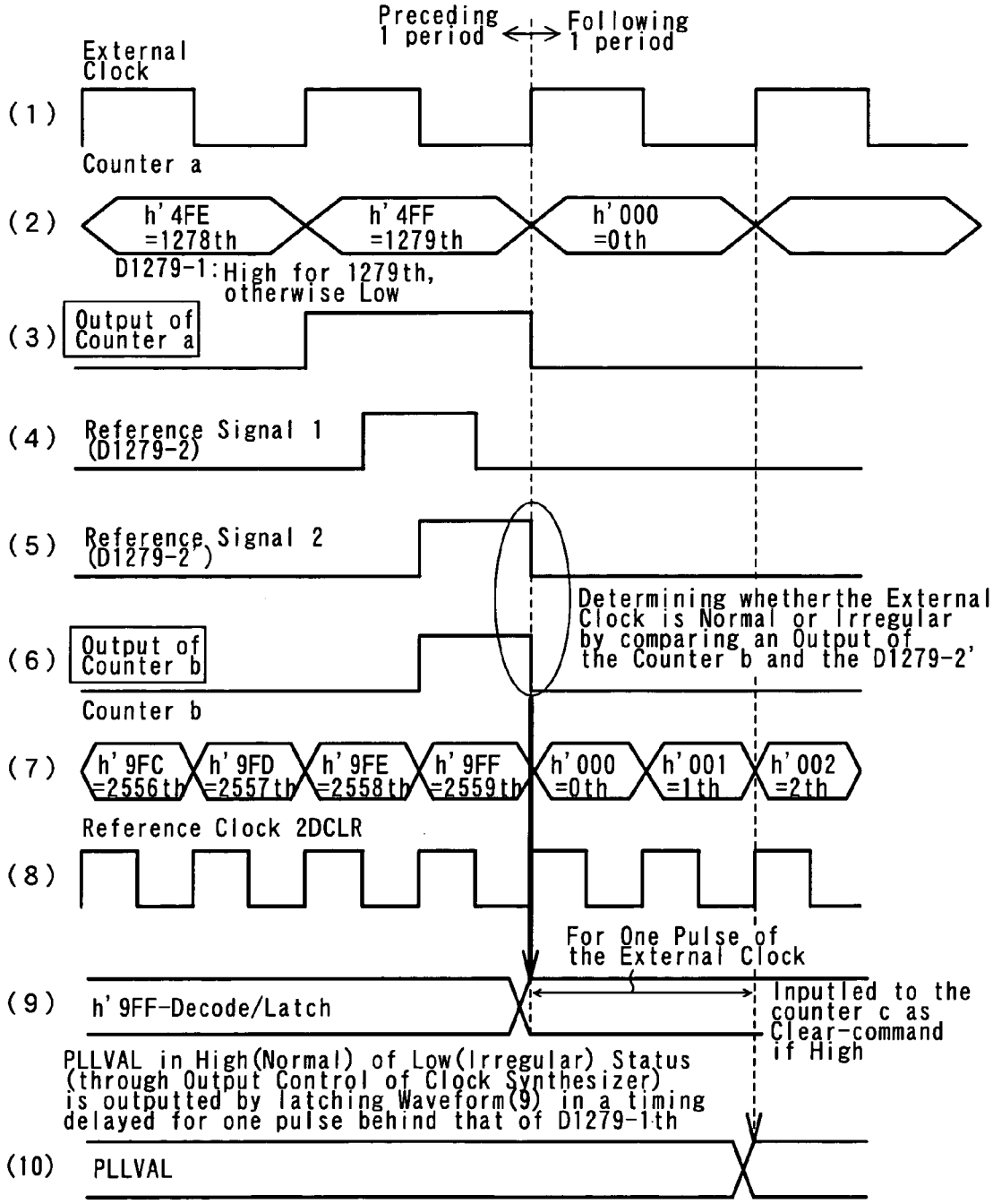
FIG. 5 is a waveform diagram illustrating in further detail the operation shown in FIG. 2 which is performed by the clock surveillance circuit.

FIG. 5 is a waveform diagram which illustrates the operations in FIG. 2 in further detail. In the drawing, the order of count values is indicated by D (for example, the 1279th count value is indicated as D 1279th).

In FIG. 5, waveform (1) represents an external clock inputted from a host computer (image clock=reference clock=1280), and waveform (2) indicates the count value of the counter-a. Moreover in FIG. 5, waveform (3) indicates a decode signal of the counter-a, waveform (4) indicates a pulse generated by synthesizing an output of the counter-a and the reference clock (a pair of DCLKs) (=D1279-2=reference signal 1), waveform (5) indicates a reference signal 2 (=D1279-2') generated by synthesizing the reference signal 1 and the reference clock, and waveform (6) indicates a decode signal of the counter-b. Furthermore in FIG. 5, waveform (7) indicates the count value of the counter-b, waveform (8) indicates the reference clock (2DCLK), waveform (9) indicates a decode/latch output, and waveform (10) indicates a determination output PLLVAL, respectively.

First of all, the counter-a counts the external clock DCLK. The output of the counter-a assumes the high level when the count D is 1279 (D1279th) and assumes the low level when the counter D is at another count.

Figure 6:
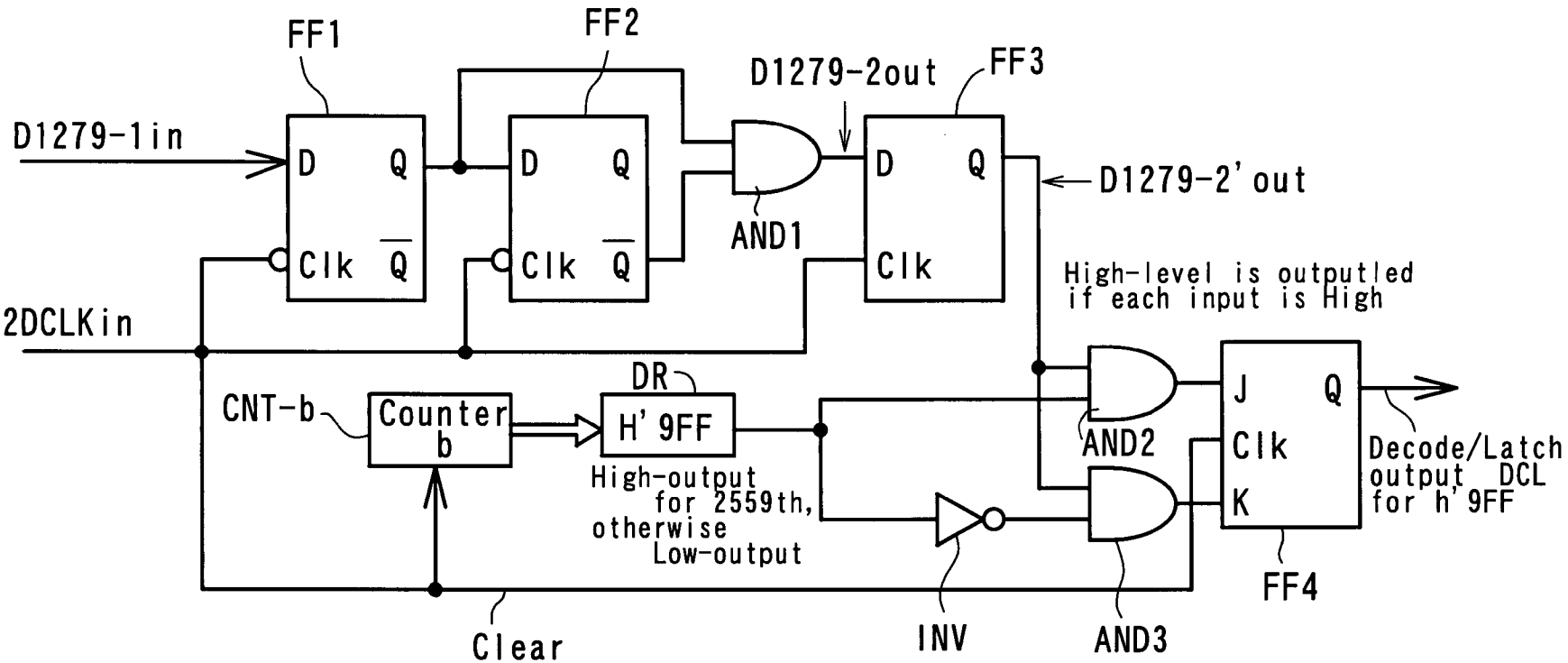
FIG. 6 is a block diagram showing an example of a clock comparator circuit CCM constituting the clock surveillance circuit shown in FIG. 1.

The determination of normal/irregular of the external clock is performed by a logic circuit (a clock comparator circuit) shown in FIG. 6, for example, in accordance with a following sequence. That is, the count/decode signal D1279-1 (3) of the counter-a and a pair of DCLKs (8) which constitute the reference clock are synthesized by a group of circuits consisting of Flip-Flops FF1, FF2 and an AND circuit AND1 so as to obtain the first reference signal D1279-2 (4). Thereafter, the second reference signal D1279-2' (5), which is obtained by synthesizing the first reference signal D1279-2 and the reference clock (8) using the Flip-Flop FF3, is compared with the decode signal (6) of the counter-b.

Assuming a case in which the 2560 pulse of the reference clock is generated by multiplying the frequency of 1280 of the external clock twice, at a point of time that a certain 1 period (for example, 1 frame period or 1 vertical scanning period) is completed and the next 1 period which succeeds the certain 1 period is started, the external clock outputs the 1279th signal (h'4FF) at the last stage of the above-mentioned "certain 1 period" and the reference clock generates the 2559th signal (h'9FF) at the last stage of the above-mentioned "certain 1 period" and, thereafter, generates 0th signals (h'000) of the above-mentioned following period.

In case the counter-b outputs the signal (6) of high level only when the b counter recognizes that the count value (7) has reached to h'9FF of the reference clock, that is, the 2559th signal (the last clock signal in the above-mentioned certain period), the signal (6) and the output (5) of the above-mentioned reference signal 2 are correlated with each other by means of a group of circuits consisting of AND circuits AND2, AND3 and a Flip-Flop FF4, and, when both agree with each other at the high level, the decode/latch signal is set to the high level. The decode/latch signal is inputted to the counter-c, which will be explained later, and the counter-c performs either one of the integration of the number of occurrences of an irregularity of the external clock or a resetting of the value in response to the level (high or low) of the decode/latch signal.

In the above-mentioned example, it is determined that the external clock is normal when the reference signal 2 (5) and the output of the counter-b (6) agree with each other, and hence, the decode/latch signal of high level corresponding to the normal external clock resets the number of generated irregularities of the integrated external clocks at the counter-c.

On the other hand, when the reference signal 2(5) and the counter-b output (6) do not agree to each other, (that is, when at least one of the reference signal 2(5) and the counter-b output (6) assumes the low level in the above-mentioned example), the decode/latch signal assumes the low level and the counter-c integrates the number of generated irregularities of the external clock for the above-mentioned every 1 period.

The levels of the reference signal 2(5), the counter-b output (6) which are used for the determination of the external clock and the decode/latch signal indicative of the output of the result of the determination are not limited to the above-mentioned example and may be suitably inverted in response to the constitutions of the clock comparator circuit and the counter-c.

Further, when the frequency of the reference clock is set to be lower than the frequency of the external clock, for example, the decode signal of the counter-b (outputting a peculiar signal with respect to the last clock signal in the above-mentioned certain 1 period) is synthesized with the external clock, thus generating the reference signal, and the reference signal way be used as the decode signal of the above-mentioned counter-a.

The determination output PLLVAL (9) is inputted to the parallel-serial converter which is arranged as a latter stage of the clock comparator circuit and the counter-c. The counter-c recognizes the fluctuation of the determination output PLLVAL (10) at a timing such that the external clock DCLK is delayed by I pulse from the output D1279-1*th* of the counter-a.

When the determination output PLLVAL (10) indicates the low level, the counter-c counts up the number of generated irregularities of the external clock for the above-mentioned every 1 period. When this count-up numerical value reaches the previously mentioned predetermined value, the counter-c operates to reset the clock synthesizer as mentioned previously.

FIG. 6 is a block diagram showing one example of the clock comparator circuit CCM, which constitutes the clock surveillance circuit shown in Fig. I, This circuit is, as illustrated in the drawing, comprised of the Flip-Flops FF1, FF2, FF3, FF4, and AND circuits AND1, AND2, AND3, an inverter INV, the counter-b CNT-b and the decoder DR of (h'9FF). Respective clocks, count values and other signals in the drawing correspond to respective signals in FIG. 1 to FIG. 5 and serve to obtain the decode/latch output DCL of the decoder DR from the Flip-Flop FF4.

Due to the first embodiment of the present invention which has been explained heretofore, when the clock surveillance means operates to detect the irregularity of timing of the clock, it is determined that the clock is not being inputted normally. That is, it can be determined that this state is the state in which the host computer has not yet completely reached the operable state or is in a transitional period which follows the change of the operation mode, and hence, the protective processing which prevents the generation of a display irregularity can be performed by bringing the inner power source into the inoperable state at the liquid crystal display side.

Figure 7:
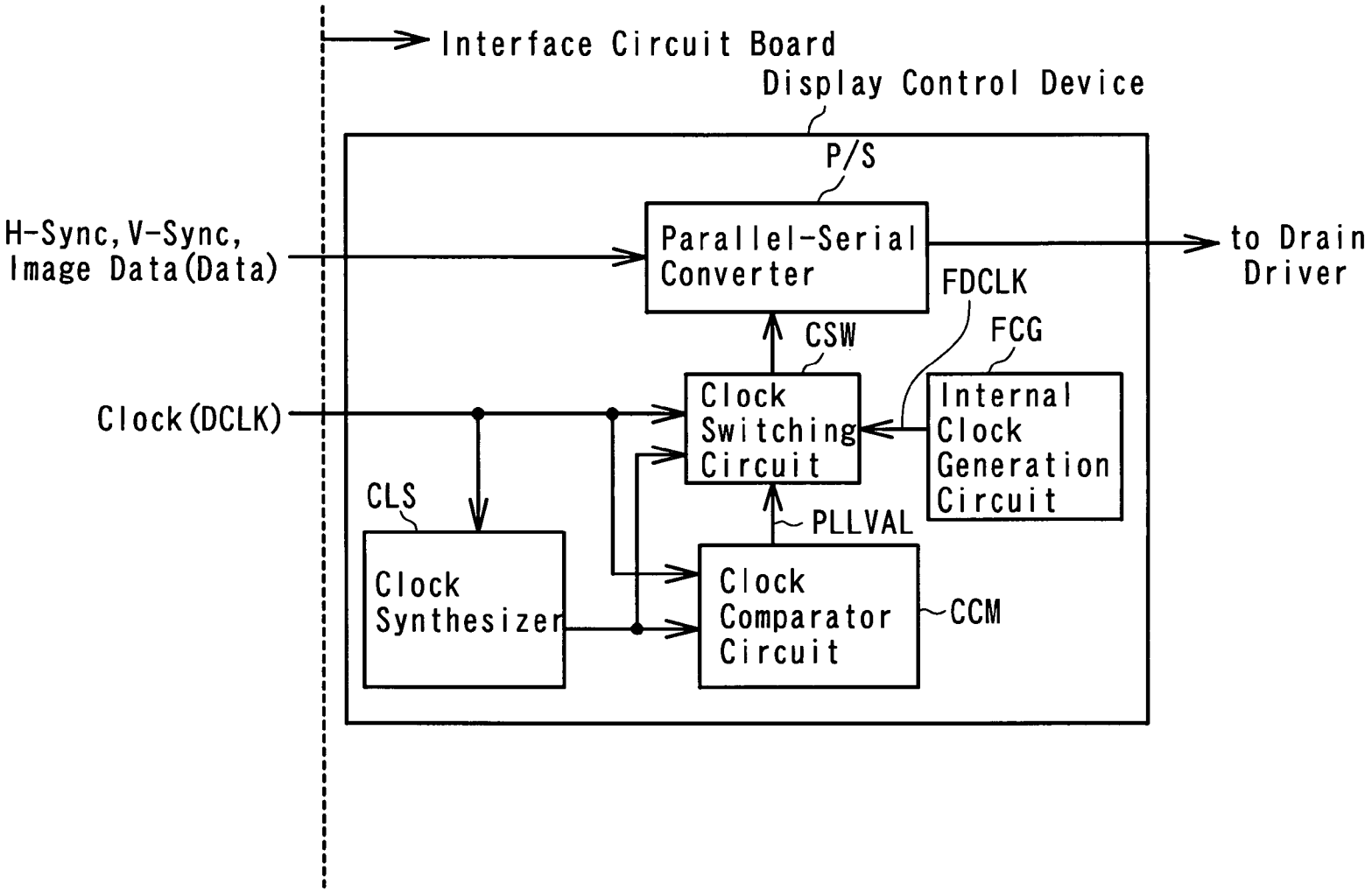
FIG. 7 is a block diagram for explaining the constitution of an essential part of a second embodiment of a liquid crystal display device according to the present invention.

FIG. 7 is a block diagram of a second embodiment of the display control device in a liquid crystal display device according to the present invention. In this embodiment, the liquid crystal display device includes clock surveillance means which is constituted by a clock synthesizer CLS and a clock comparator circuit CCM, and which detects the presence or the absence of an irregularity in the timing of a clock signal DCLK inputted from an external signal source, and an inner clock generation circuit FCG, which generates a pseudo clock FDCLK equivalent to the clock signal DCLK.

In the previous embodiment, when an irregularity in the timing of the clock is generated, the protective processing which prevents the generation of an irregularity in the display by bringing the inner power source into an inoperable state is performed. However, in this embodiment, when the clock surveillance means detects an irregularity in the timing, the pseudo clock signal generated by the above-mentioned inner clock signal generation circuit is supplied to the display control device so as to display a pseudo image.

The inner clock signal generation circuit is controlled in response to the resistance, the capacitance or a quartz oscillator and generates clocks for an image display. These electronic components may be mounted at the outside of the inner clock signal generation circuit or an integrated circuit element (large-scale integrated circuit) which surrounds the inner clock signal generation circuit. For example, these electronic components may be mounted on the same printed circuit board together with the above-mentioned integrated circuit elements.

Due to this embodiment, when the clock surveillance means detects the irregularity of timing by the clock, the pseudo screen display is performed so as to obviate the irregular display, and the normal image display can be performed at a point of time at which the above-mentioned timing is restored.

The liquid crystal display panel and other constitutional portions which constitute the liquid crystal display device according to the present invention will be explained.

Figure 8:
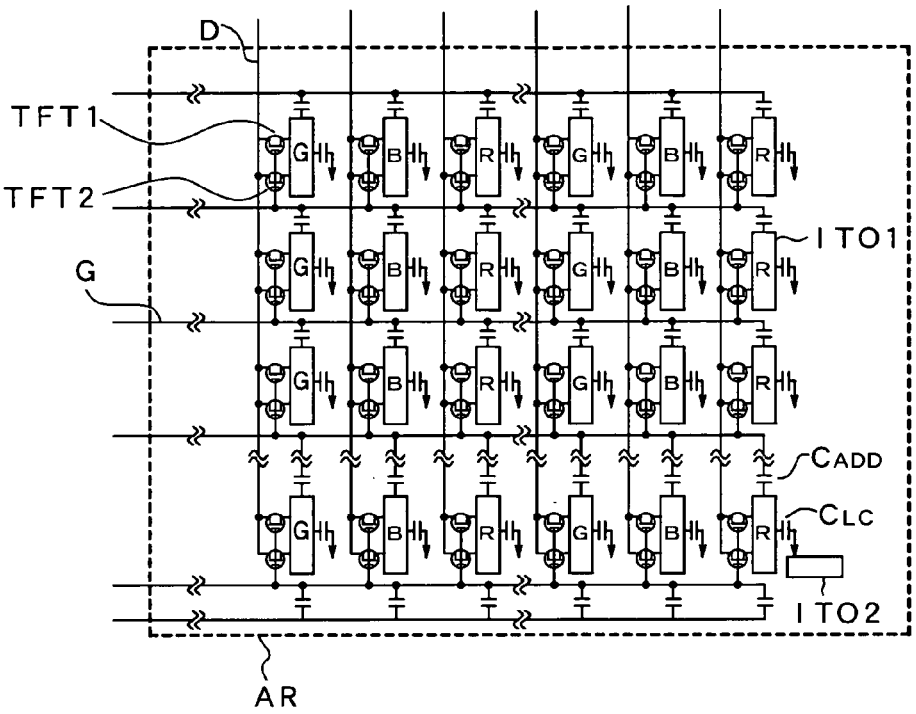
FIG. 8 is an equivalent circuit diagram showing one example of a pixel portion of a liquid crystal display panel constituting a liquid crystal display device according to the present invention.

FIG. 8 shows an equivalent circuit representing one example of a pixel portion of the liquid crystal display panel which constitutes the liquid crystal display device according to the present invention. Here, the drawing corresponds to an actual geometric arrangement of pixels, and a plurality of pixels which are arranged in a matrix array in an effective display area AR (pixel portion) are constituted of two thin film transistors TEE (TFT1, TFT2) per one pixel.

Symbol D indicates drain signal lines, symbol 6 indicates gate signal lines, and R, G and B denote pixel electrodes of respective colors (red, green, blue) that are formed of ITO1. Further, ITO2 indicates a counter electrode (common electrode), CLC indicates liquid crystal capacitance for indicating a liquid crystal layer equivalently and CADD indicates an additional capacitance formed between a source electrode of the thin film transistor TFT and the gate signal line G of a preceding stage.

Figure 9:
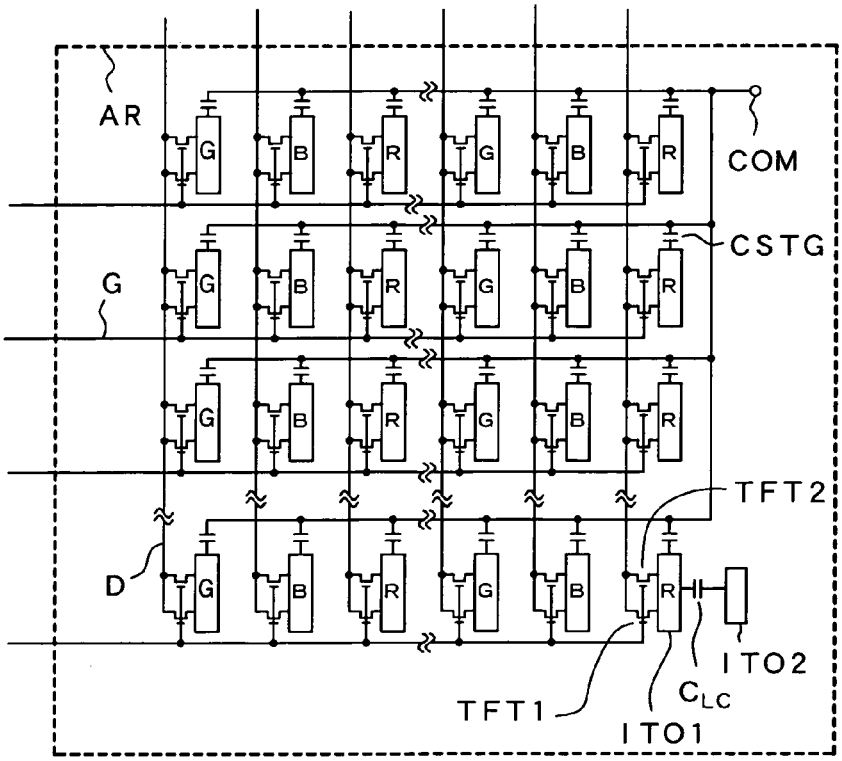
FIG. 9 is an equivalent circuit diagram showing another example of the pixel portion of the liquid crystal display panel constituting the liquid crystal display device according to the present invention

FIG. 9 shows an equivalent circuit representing another example of a pixel portion of a liquid crystal display panel which constitutes a liquid crystal display device according to the present invention. This drawing also corresponds to an actual geometric arrangement of pixels. In the same manner as FIG. 8, a plurality of pixels which are arranged in a matrix array in an effective display area AR (pixel portion) are constituted of two thin film transistors TFT (TFT1, TFT2) per one pixel. Although two thin film transistors TFT are provided per one pixel in FIG. 8 and FIG. 9, there is a known liquid crystal display device which constitutes one thin film transistor TFT per one pixel.

In the same manner, symbol D indicates drain signal lines, symbol 0 indicates gate signal lines, R, G and B denote pixel electrodes of respective colors (red, green, blue), ITO2 indicates a counter electrode (common electrode), CLC indicates a liquid crystal capacitance for indicating a liquid crystal layer equivalently and CSTG indicates holding capacitances formed between common signal lines COM and the source electrodes. However, this liquid crystal display device differs from the liquid crystal display device in FIG. 8 in that the additional capacitance CADD in FIG. 3 is formed between the source electrode and the gate signal line G of a preceding stage.

In the above-mentioned liquid crystal display panel shown in FIG. 8 or FIG. 9, the drain electrodes of thin film transistors TFT (TFT1, TFT2) of respective pixels, which are arranged in the column direction, are respectively connected to the drain signal lines D, and respective drain signal lines D are connected to the drain drivers, to which voltages of display data of the pixels arranged in the column direction are applied.

Further, the gate electrodes of the thin film transistors (TFT1, TFT2) in respective pixels arranged in the line direction are respectively connected to the gate signal lines G, and respective gate signal lines G are connected to the gate drivers which supply scanning driving voltages (positive or negative bias voltages) to the gates of the thin film transistors TFT (TFT1, TFT2) for 1 horizontal scanning time.

Although the present invention is applicable to any liquid crystal display device using the liquid crystal display panels which have the constitutions shown in the above-mentioned FIG. 8 and FIG. 9, in the former liquid crystal display panel, the pulses of the gate signal line G of a preceding stage jumps into the pixel electrodes ITO1 through the additional capacitance CADD, while in the latter liquid crystal display panel, there is no such jumping of pulses so that it is possible to obtain a more favorable display.

Figure 10:
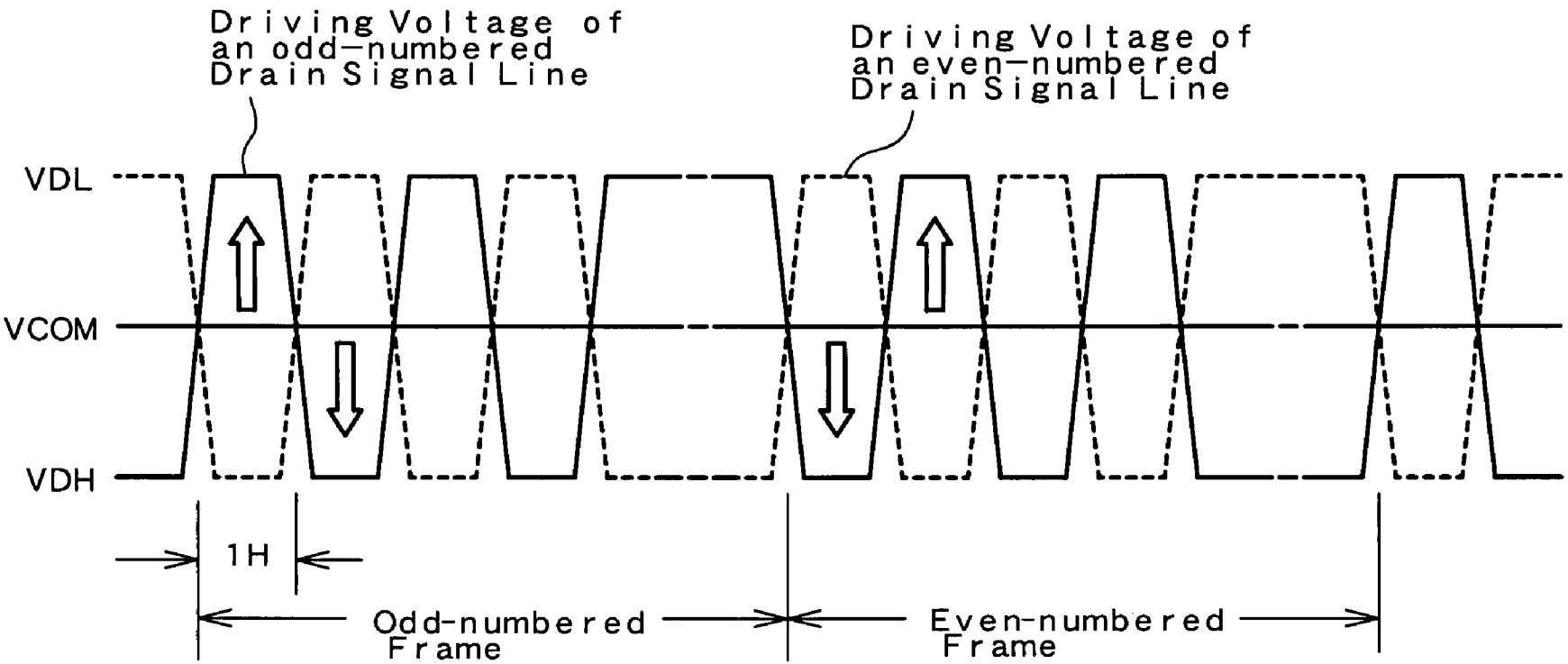
FIG. 10 is a timing chart illustrating in detail the relationship between the liquid crystal driving voltage outputted to drain signal lines from the drain driven and the liquid crystal driving voltage applied to a common electrode.

FIG. 10 is a timing diagram shows in detail the relationship between the liquid crystal driving voltages outputted to the drain signal lines from the drain drivers, that is, the liquid crystal driving voltage applied to the pixel electrodes ITO1 and the liquid crystal driving voltage applied to the common electrode ITO2. Here, the liquid crystal driving voltage outputted to the drain signal lines D from the drain drivers serves to display black on a display surface of the liquid crystal display panel.

As shown in FIG. 10, the liquid crystal driving voltage VDH outputted to the odd-numbered drain signal lines D from the drain drivers and the liquid crystal driving voltage VDL outputted to the even-numbered drain signal lines D from the drain drivers have an inverse polarity with respect to the liquid crystal driving voltage VCOM applied to the common electrode ITO2. That is, when the liquid crystal driving voltage VDH outputted to the odd-numbered drain signal lines D has a positive polarity (or negative polarity), the liquid crystal driving voltage VDL outputted to the even-numbered drain signal lines D has a negative polarity (or positive polarity).

Further, the polarity is inverted at every 1 line (1H) and the polarity for every line is inverted at every frame. With the use of this dot inversion method, the voltages applied to the neighboring drain signal lines D have polarities that are opposite to each other, and hence, the currents which flow into the neighboring common electrodes ITO2 and the neighboring gate signal lines G cancel each other, so that the power consumption can be reduced.

Further, since the current which flows into the common electrode ITO2 is small, the voltage drop is not increased, whereby the voltage level of the common electrode ITO2 becomes stable and the deterioration of the display quality can be reduced.

Figure 11A:
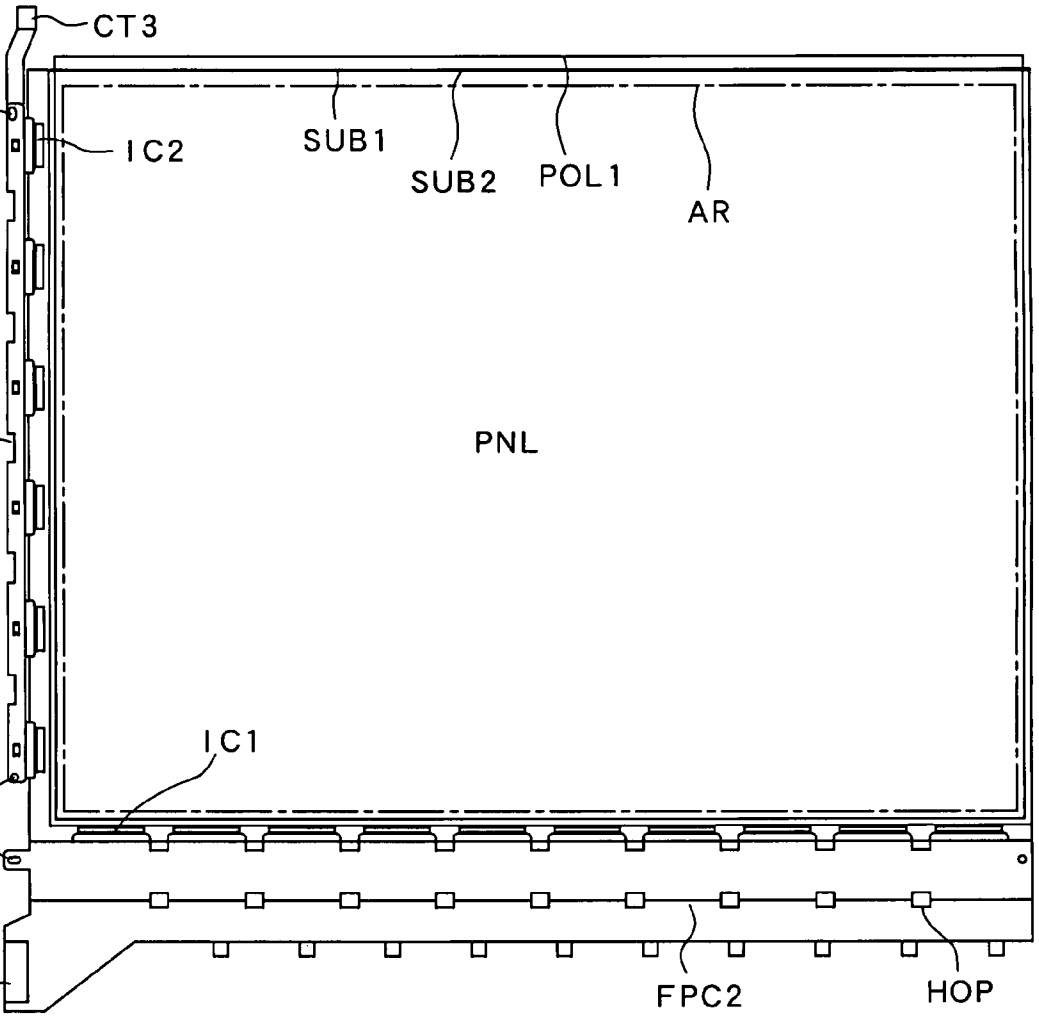

FIG. 11A is a plan view of the liquid crystal display panel showing the mounting position of the interface circuit board. On a lower side of the liquid crystal display panel PNL, a flexible printed circuit board FPC2 is mounted, which mounts drain drivers IC1 that are bent along a column of holes HOP toward aback surface of the liquid crystal display panel PNL, as indicated by FIG. 11A.

Further, on the left side of the liquid crystal display panel PNL, the flexible printed circuit board FPC1 is mounted, which mounts the gate drivers IC2 that are bent toward the back surface of the liquid crystal display panel PNL.

Figure 11B:
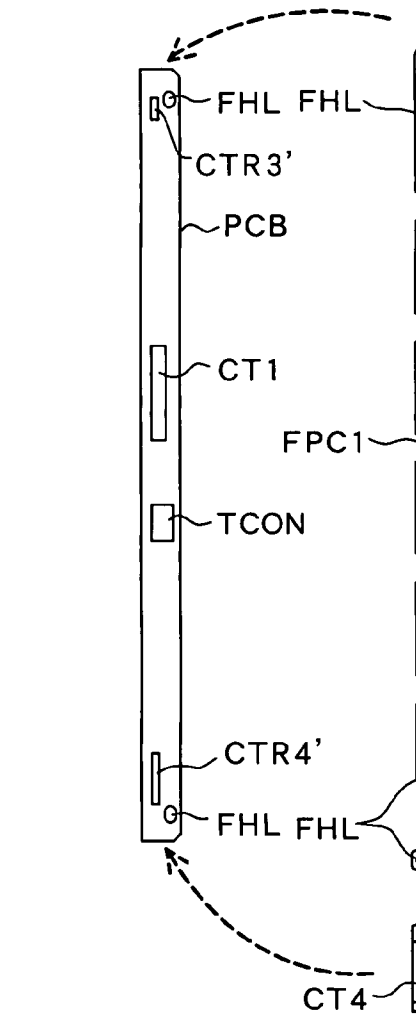
Figure 12:
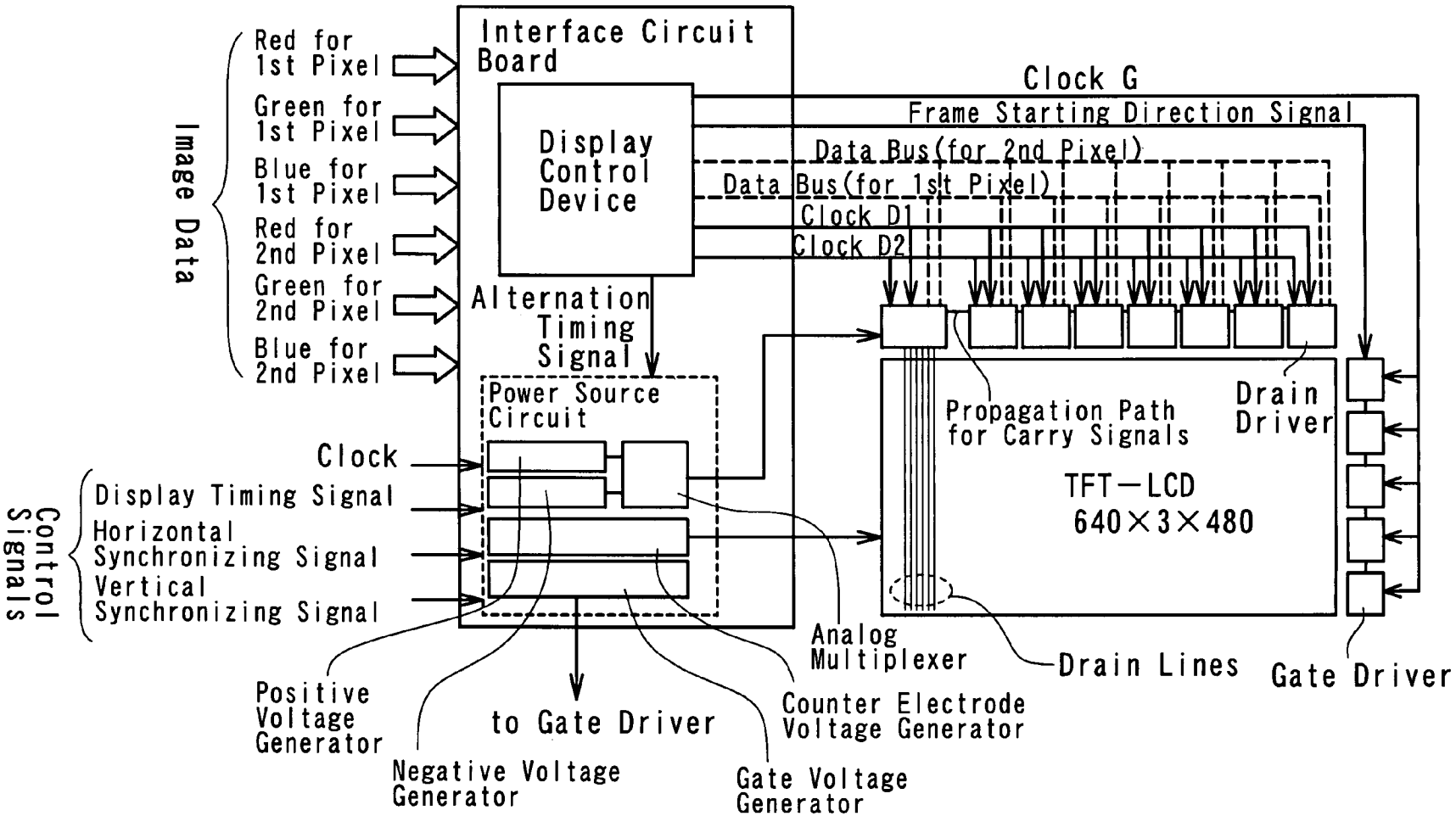
FIG. 12 is a block diagram showing an example of an active matrix type liquid crystal display device.
Figure 13:
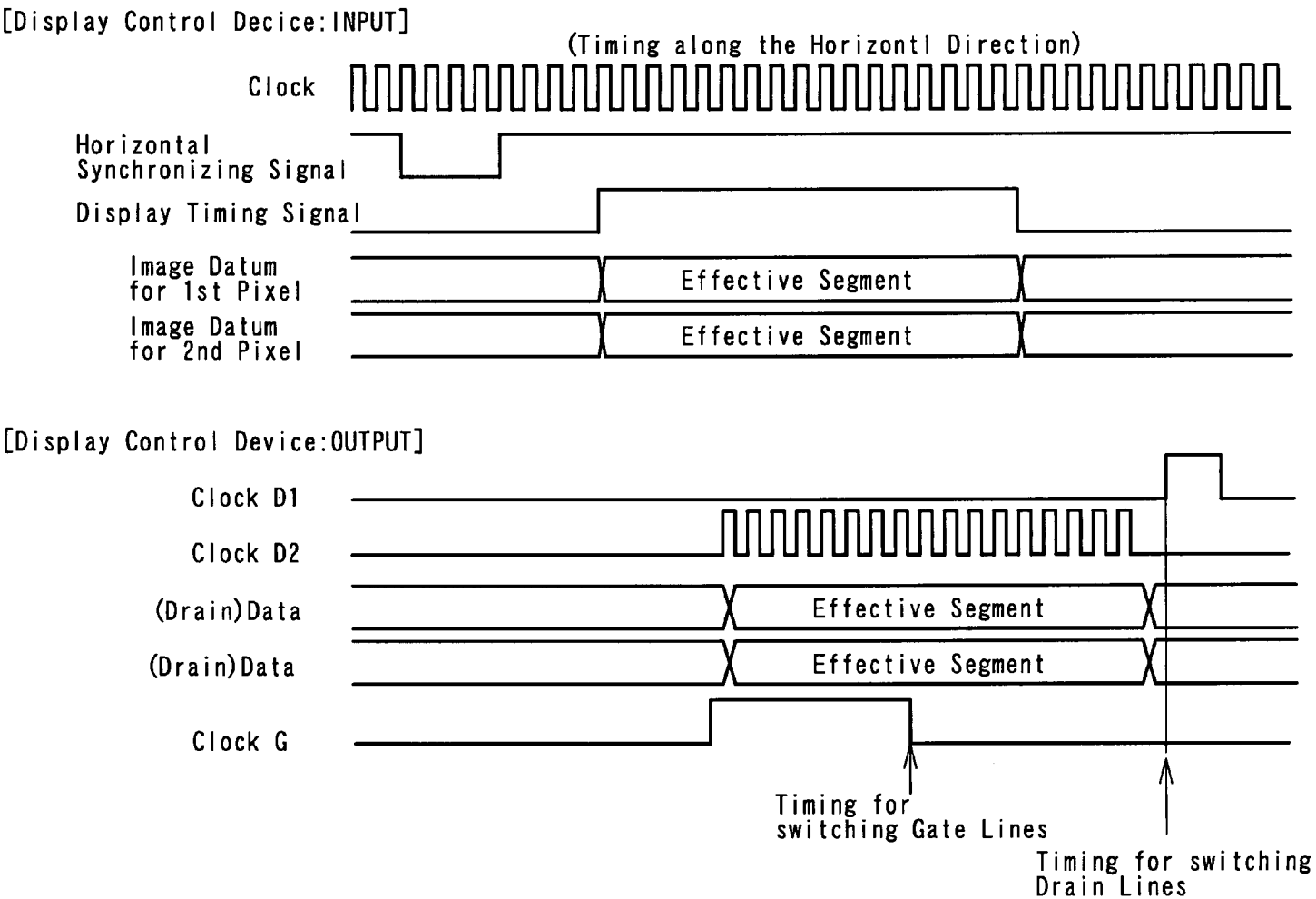
FIG. 13 is a diagram of the timing in the lateral direction, that is, in the horizontal direction with respect to the display control in FIG. 12.
Figure 14:
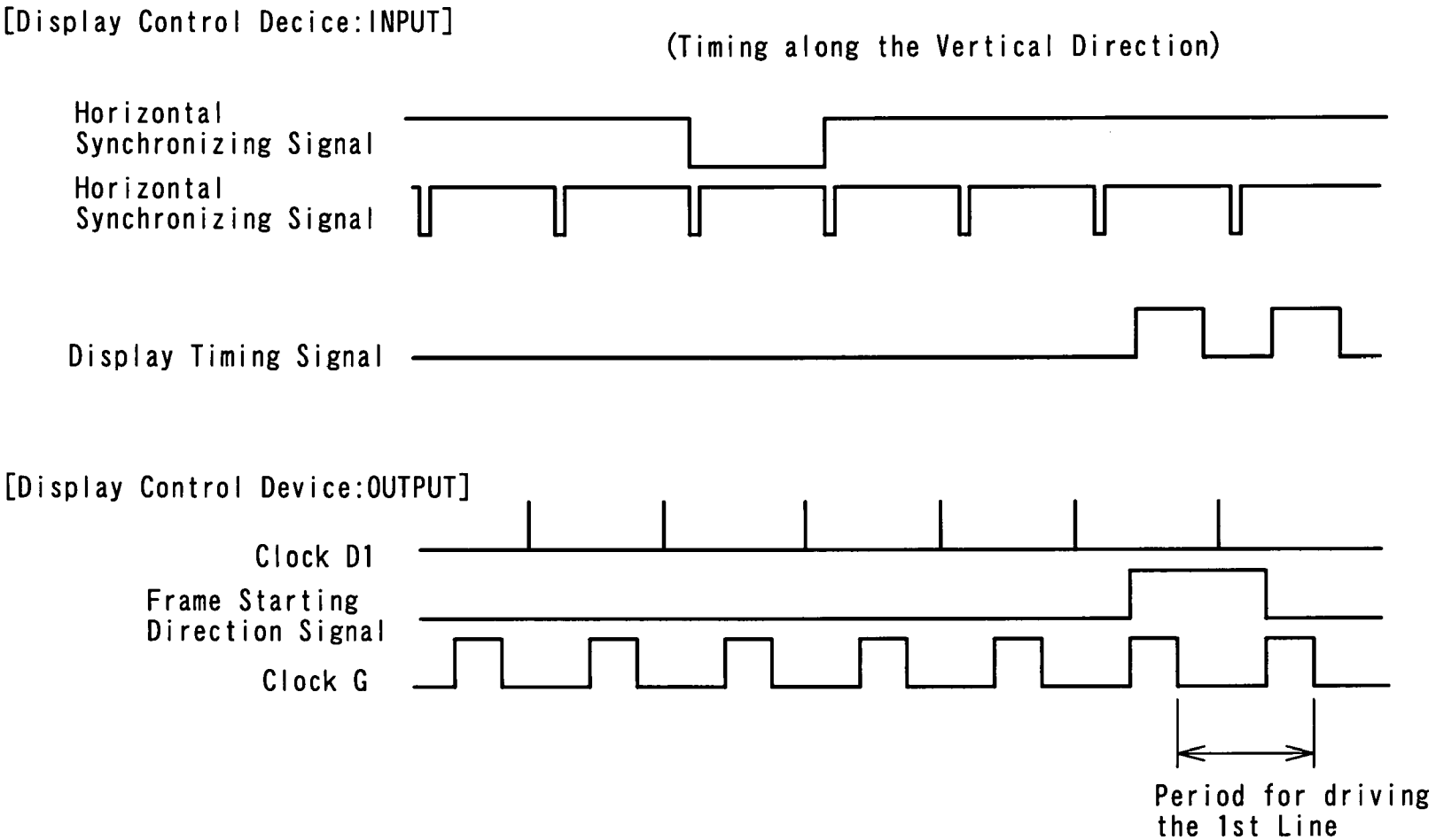
FIG. 14 is a diagram of the timing in the longitudinal direction, that is, in the vertical direction with respect to the display control in FIG. 12.
Figure 15:
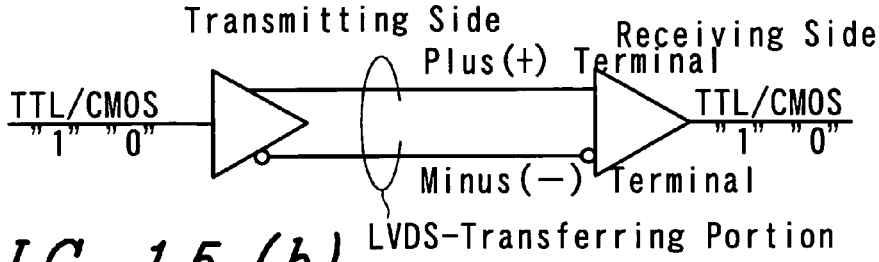
FIGS. 15(*a*) and 15(*b*) are views illustrating the LVDS transferring method, wherein FIG. 15(*a*) is a schematic diagram illustrating the LVDS transfer method, and FIG. 15(*b*) is a diagram showing alternating data signals.
Figure 15:
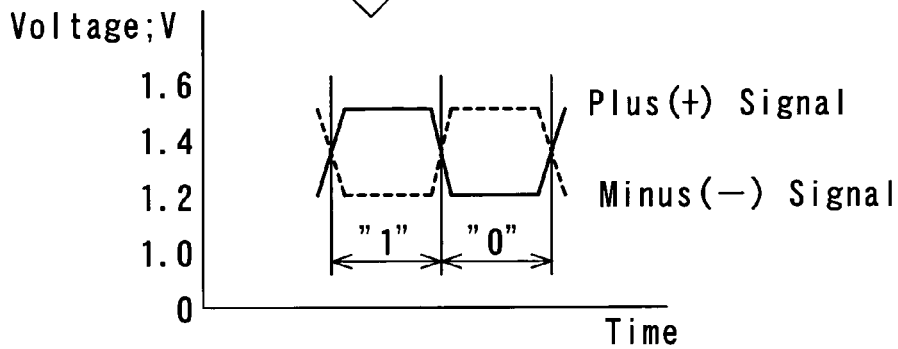
Figure 16:
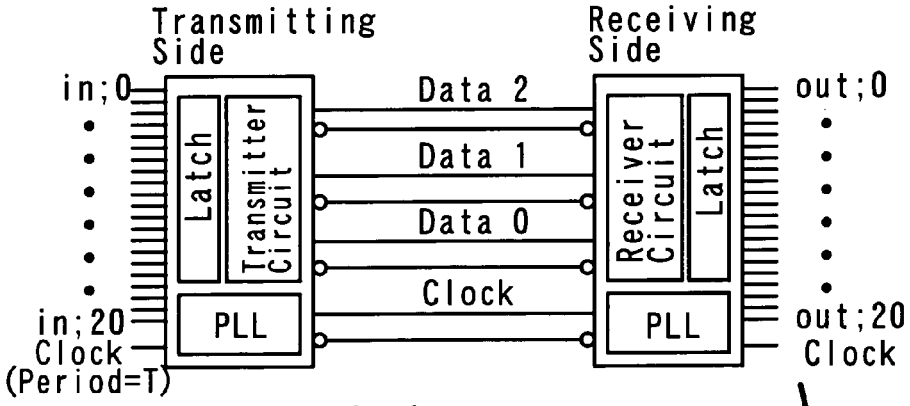
FIGS. 16(*a*) and 16(*b*) are basic views illustrating the LVDS transferring method, wherein FIG. 16(*a*) is a diagram of transferring lines of the LVDS, and FIG. 16(*b*) is a diagram of display data and clocks which are transferred through the transferring lines of the LVDS.
Figure 16:
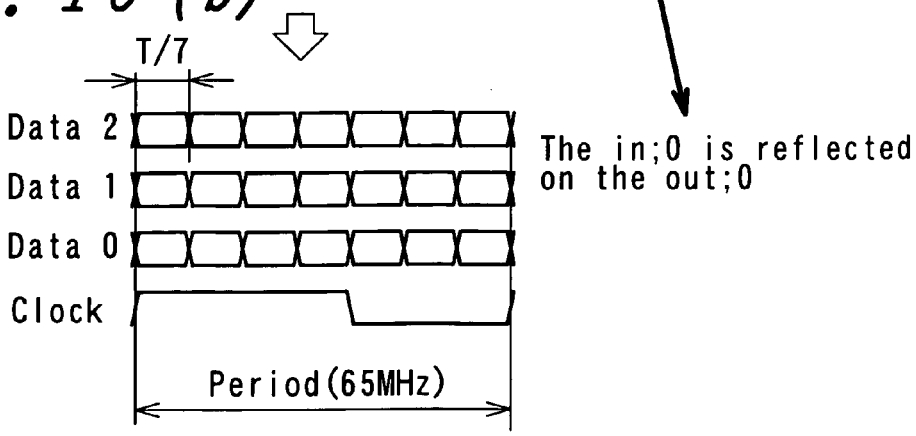
Figure 17:
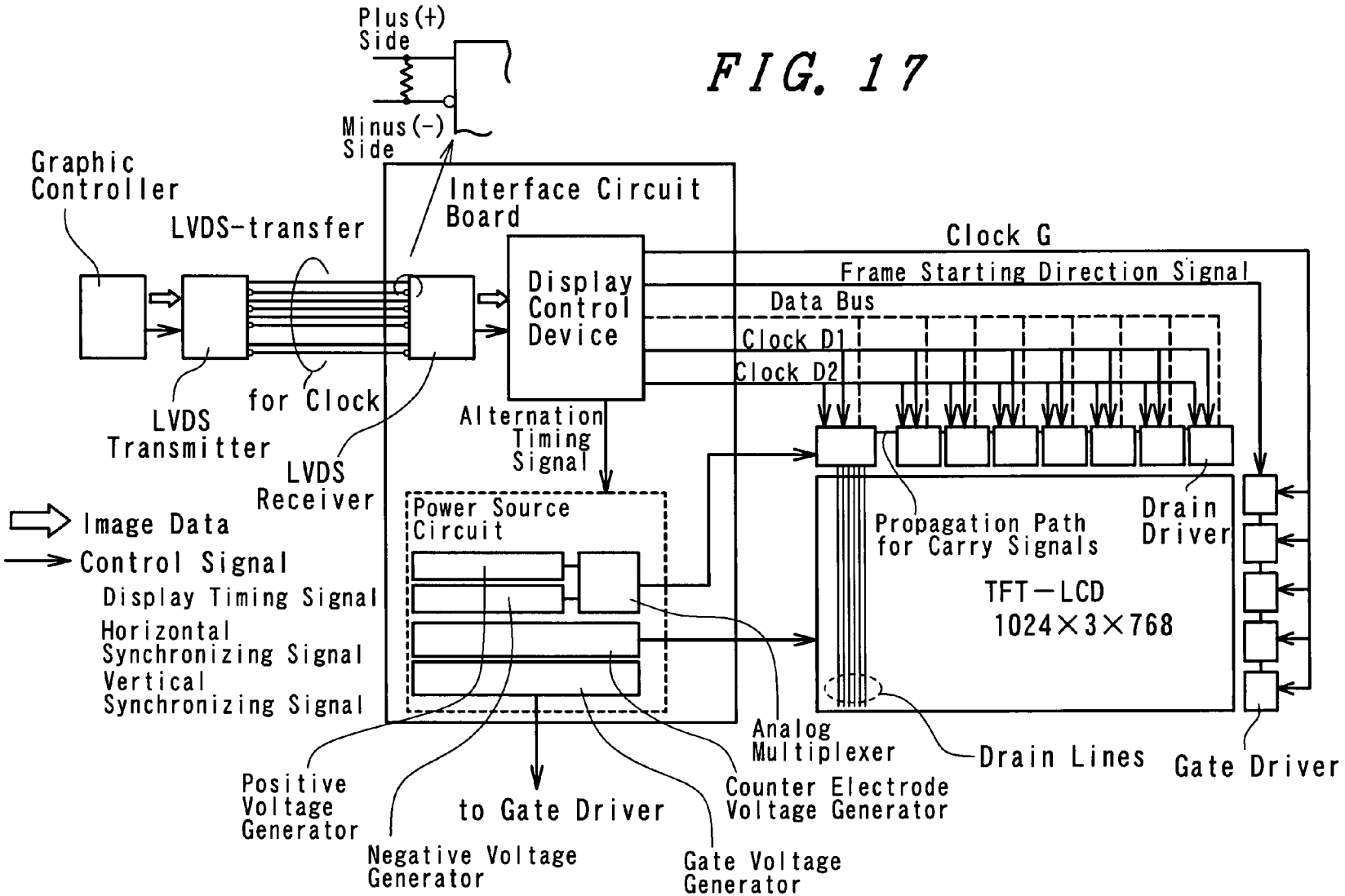
FIG. 17 is a block diagram showing an example of a liquid crystal display device which uses the LVDS transfer method.
Figure 18:
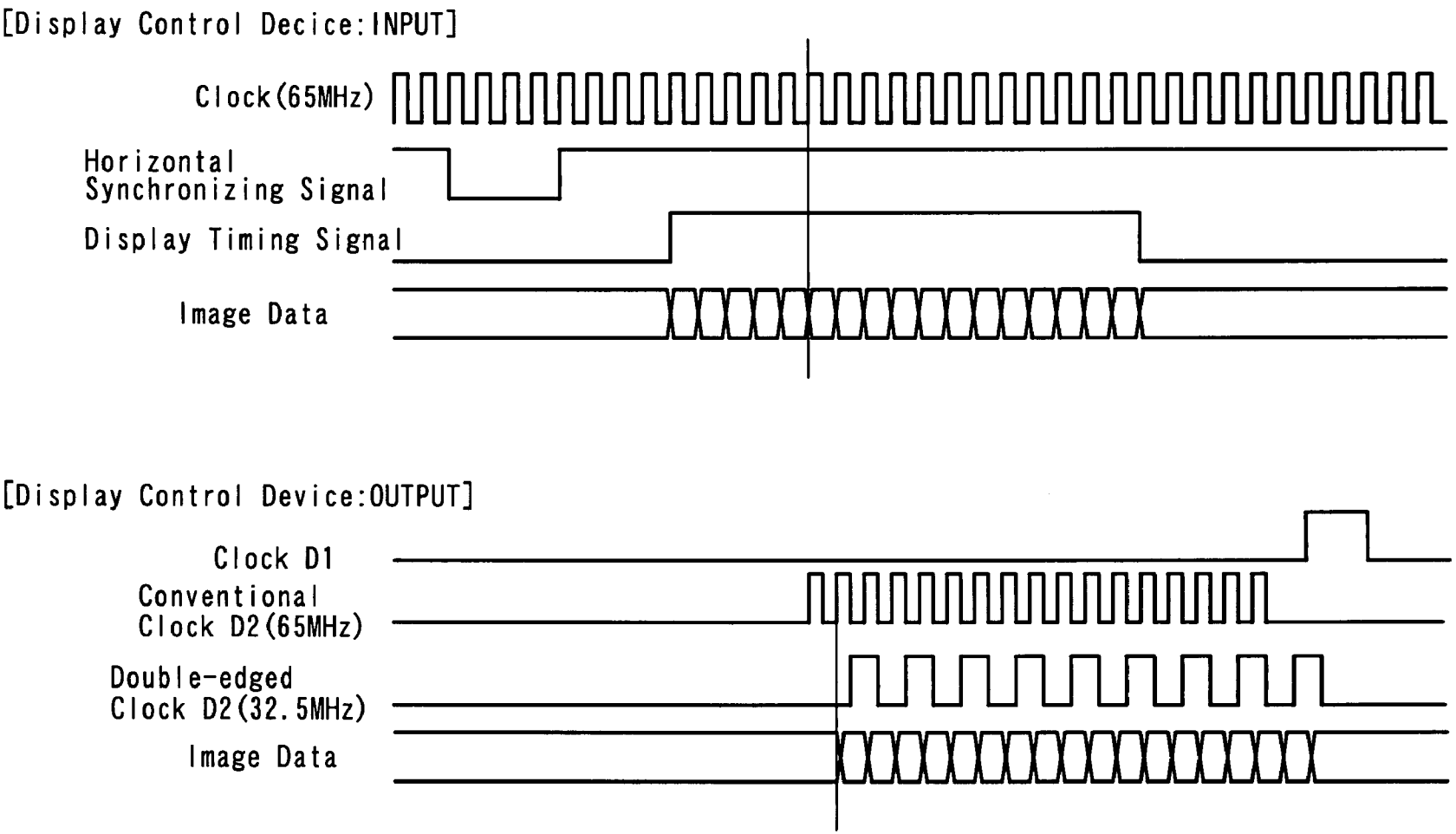
FIG. 18 is a timing chart of an input and an output of the display control device using a double-edged specification.
Figure 19:
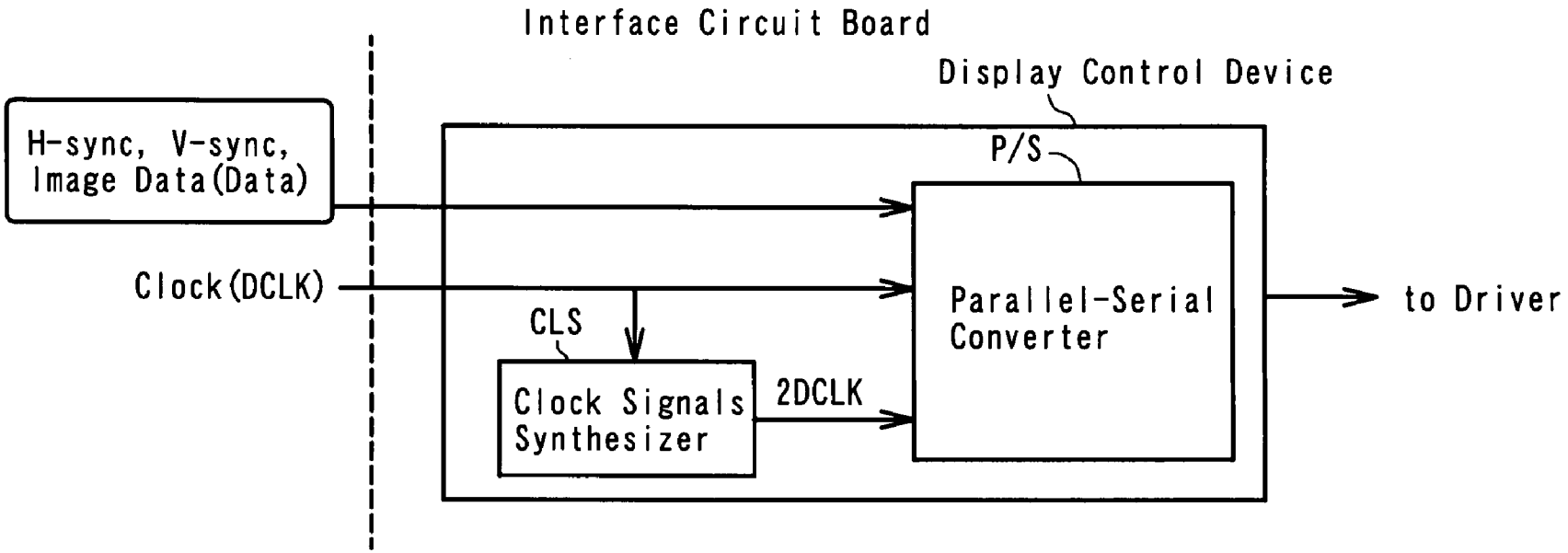
FIG. 19 is a block diagram illustrating the basic features of a double-edged image data fetching method.
Figure 20:
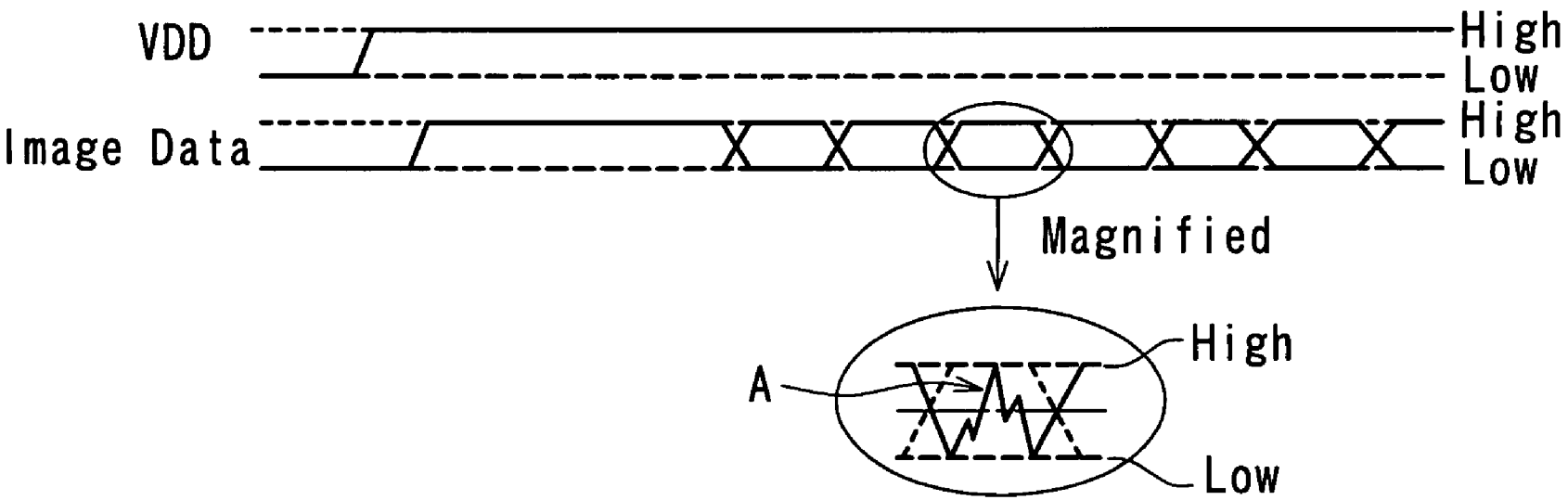
FIG. 20 is a waveform diagram showing the operation illustrated in FIG. 19.
Figure 21:
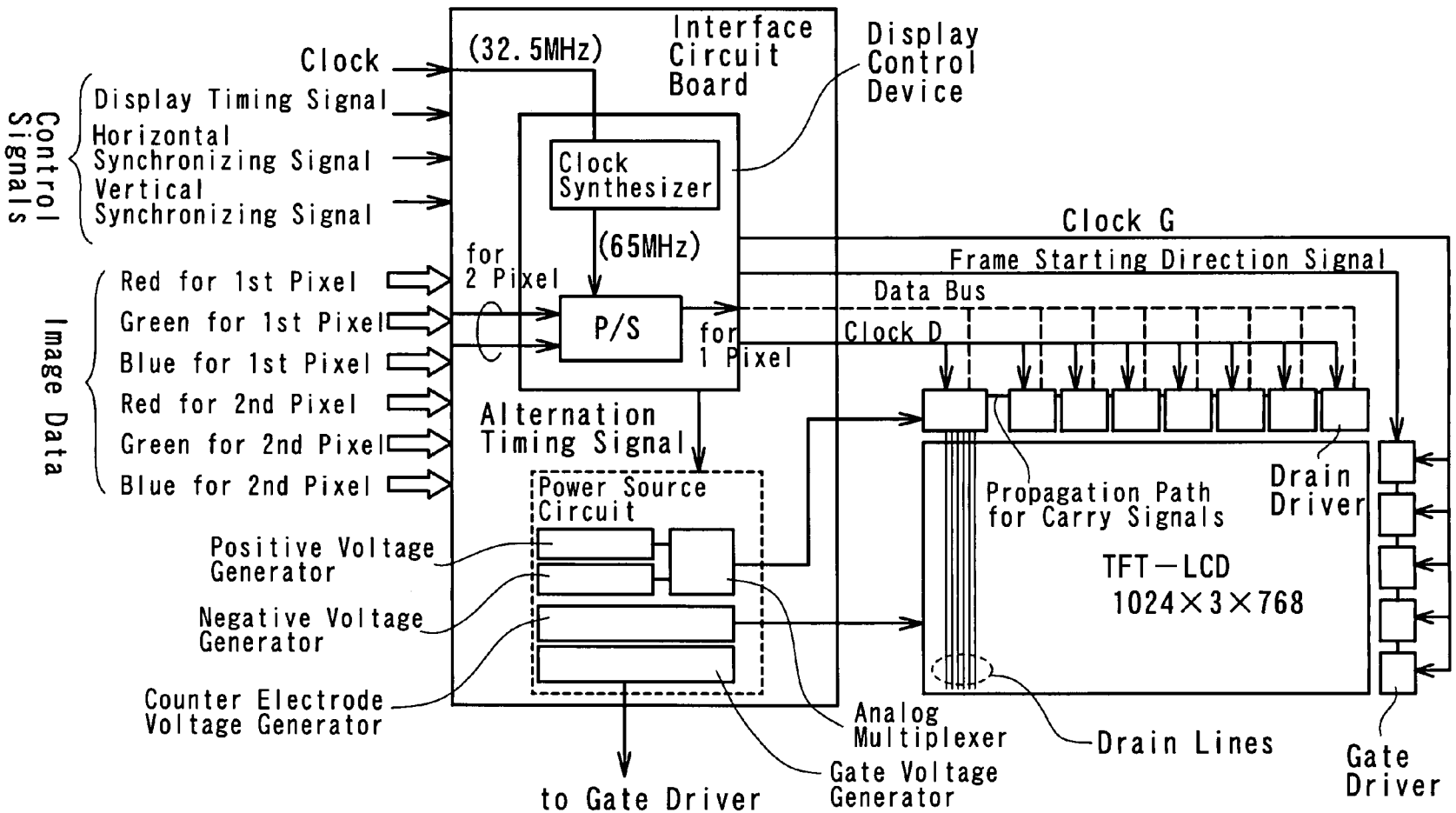
FIG. 21 is a block diagram showing an example of a liquid crystal display device which uses a double-edged image data fetching method.

On a back surface of the flexible printed circuit board FPC1, the interface printed circuit board PCB shown in FIG. 11B is mounted. The TCON, which is mounted on the interface printed circuit board PCB, is a semiconductor integrated circuit which constitutes the display control device.

Various signals, such as the clocks and image data from the host computer, are inputted to a connector CT1 of the interface printed circuit board PCB. A connector CT3 of the flexible printed circuit board FPC1 is connected to a connector CT3' of the interface printed circuit board PCB, and a connector CT4 of the flexible printed circuit board FPC2 is connected to a connector CF4' of the interface printed circuit board PCB, so that the above-mentioned clocks and image data outputted from the TCON of the display control device are supplied.

Here, in the liquid crystal display panel PNL, a liquid crystal layer is inserted into a gap formed between an upper substrate SUB1 and a lower substrate SUB2, which are laminated to each other, and an upper polarizer POL1 is laminated on an uppermost layer of the liquid crystal display panel PNL. Although not shown in the drawing, a lower polarizer is laminated to an uppermost layer of a back surface of the liquid crystal display panel. AR indicates the effective display area.

By applying the above-mentioned embodiments to the liquid crystal display device having the above-mentioned constitution, the liquid crystal display device recognizes whether the external clock is normal or not and stops the supply of the video signals to the drivers of the liquid crystal display devices, or performs the display by replacing the external clock with the pseudo clock from the pseudo clock generation circuit provided separately, when the external clock is irregular, so that it is possible to provide a liquid crystal display device which can obviate the generation of a display irregularity and can generate an image display of high definition without necessitating high-speed transfer of display data from the host computer.

As has been explained heretofore, according to the present invention, with the use of an interface, which does not change the constitution of the host computer side, that is, with the use of an interface which does not adopt the LVDS method, it is possible to fetch display data into the drain drivers using double edges of the low pixel clock frequency. Further, the liquid crystal display device recognizes whether the external clock is normal or not and stops the supply of the image signals to the drain drivers of the liquid crystal display devices, or performs the display by replacing the external clock with the pseudo clock from the pseudo clock generation circuit provided separately, when the external clock is irregular, so that it is possible to provide a liquid crystal display device which can obviate the generation of a display irregularity and can generate an image display of high definition.

What is claimed is:

1. A liquid crystal display device comprising:

a liquid crystal display panel which has a plurality of pixels constituted of active elements and formed in a matrix;

a plurality of drain drivers which apply driving voltages based on control signals including image data and pixel clock signals inputted from an external signal source to a plurality of pixels in a lateral direction of the matrix;

a plurality of gate drivers which apply scanning voltages to a plurality of pixels in a longitudinal direction of the matrix; and a display control device having parallel-serial conversion means which performs a parallel-serial conversion of the image data based on the pixel clock signals and supplies the image data to the drain drivers, wherein the display control device comprises:

a clock signal synthesizer which generates reference clock signals formed by multiplying a frequency of the pixel clock signals inputted from the external signal source "a" times, and a clock signal comparator circuit which compares the inputted pixel clock signals and an output of the reference clock signals of the clock signal synthesizer, determines whether it is effective or ineffective based on the presence or the absence of the irregularity of timing of the pixel clock signals, and outputs a clock ineffective signal which stops the supply of the pixel clock signals to the parallel-serial converting means, when the result of the determination is ineffective, provided that the number of the image data is set to N pieces, the number of display data inputted to the drain drivers of the liquid crystal display panel is set to M pieces, and N/M is set to satisfy the relationship of 1/a (a: integer), the N pieces of display data is converted into M pieces of display data ($M \leqq N$) based on clocks a×CL which is obtained by multiplying the frequency "a" times using a clock multiplying circuit and, thereafter, the M pieces of display data are inputted to the drain drivers at double edges consisting of rising of signal and falling of signal of the clocks CL.

2. A liquid crystal display device according to claim 1, wherein the number of multiplication "a" of the clock signal synthesizer is n or 1/n, wherein n is an integer and satisfies $n \geqq 2$.

3. A liquid crystal display device according to claim 1, wherein the number N of image data from the external signal source is 2, the number M of image data inputted to the liquid crystal display panel is 1, the clock signal synthesizer is a PLL, and the multiplication number "a" thereof is 2.

4. A liquid crystal display device according to claim 1, wherein the frequency of the pixel clock signals inputted from the external signal source is 32.5 MHz and the drain driver is a drain driver corresponding to double edges.

5. A liquid crystal display device comprising:

a liquid crystal display panel which has a plurality of pixels constituted of active elements and formed in a matrix;

a plurality of drain drivers which apply driving voltages based on control signals including image data and pixel clock signals inputted from an external signal source to a plurality of pixels in a lateral direction of the matrix;

a plurality of gate drivers which apply scanning voltages to a plurality of pixels in the longitudinal direction of the matrix; and a display control device having parallel-serial conversion means which performs a parallel-serial conversion of the image data based on the pixel clock signals and supplies the image data to the drain drivers, wherein the display control device comprises:

a clock signal synthesizer which generates reference clock signals which are formed by multiplying the frequency of the pixel clock signals inputted from the external signal source "a" times, a clock signal comparator circuit which compares the inputted pixel clock signals and an output of the reference clock signals of the clock signal synthesizer and determines whether it is effective or ineffective based on the presence or the absence of the irregularity of timing of the pixel clock signals, an inner clock signal generation circuit which generates pseudo clock signals equivalent to the image clock signals, and a clock signal switching circuit which stops the supply of the pixel clock signals to the parallel-serial converting means and also supplies the pseudo clock signals outputted from the inner clock signal generation circuit to the parallel-serial converter when the result of the determination of the clock signal comparator circuit is ineffective;

provided that the number of the image data is set to N pieces, the number of display data inputted to the drain drivers of the liquid crystal display panel is set to M pieces, and N/M is set to satisfy the relationship of 1/a (a: integer), the N pieces of display data is converted into M pieces of display data ($M \leqq N$) based on clocks $a \times CL$ which is obtained by multiplying the frequency "a" times using a clock multiplying circuit and, thereafter, the M pieces of display data are inputted to the drain drivers at double edges consisting of rising of signal and falling of signal of the clocks CL.

6. A liquid crystal display device according to claim 5, wherein the number of multiplication "a" of the clock signal synthesizer is n or 1/n, wherein n is an integer and satisfies $n \geqq 2$.

7. A liquid crystal display device according to claim 5, wherein the number N of image data from the external signal source is 2, the number M of image data inputted to the liquid crystal display panel is 1, the clock signal synthesizer is a PLL, and the multiplication number "a" thereof is 2.

8. A liquid crystal display device according to claim 5, wherein the frequency of the pixel clock signals inputted from the external signal source is 32.5 MHz and the drain driver is a drain driver corresponding to double edges.

9. A liquid crystal display device comprising:

a liquid crystal display panel which has a plurality of pixels constituted of active elements and formed in a matrix;

a plurality of drain drivers which apply driving voltages based on control signals including image data and pixel clock signals inputted from an external signal source to a plurality of pixels in a lateral direction of the matrix;

a plurality of gate drivers which apply scanning voltages to a plurality of pixels in a longitudinal direction of the matrix; and a display control device having parallel-serial conversion means which performs the parallel-serial conversion of the image data based on the pixel clock signals and supplies the image data to the drain drivers, the display control device comprising:

a clock signal synthesizer which generates reference clock signals which are formed by multiplying the frequency of the pixel clock signals inputted from the external signal source "a" times; and a clock signal comparator circuit which counts each clock number of the pixel clock signals and the clock number of the reference clock signals, compares the each clock number, and determines whether it is effective or ineffective based on the presence or the absence of the irregularity of timing of the pixel clock signals, and outputs a clock ineffective signal which stops the supply of the pixel clock signals to the parallel-serial converting means when the result of the determination is ineffective;

wherein the frequency of the pixel clock signals inputted from the external signal source is 32.5 MHz and the drain driver is a drain driver corresponding to double edges.

10. A liquid crystal display device according to claim 9, wherein the number of multiplication "a" of the clock signal synthesizer is n or 1/n, wherein n is an integer and satisfies $n \geqq 2$.

11. A liquid crystal display device according to claim 9, wherein the number N of image data from the external signal source is 2, the number M of image data inputted to the liquid crystal display panel is 1, the clock signal synthesizer is a PLL, and the multiplication number "a" thereof is 2.

* * * * *